US005558322A

United States Patent [19]

Nakatomi

[11] Patent Number: 5,558,322

[45] Date of Patent: Sep. 24, 1996

[54] PAPER DISCHARGE UNIT FOR USE IN IMAGE FORMING APPARATUS

[75] Inventor: Yoshitsugu Nakatomi, Yokosuka, Japan

[73] Assignee: Kabushiki Kaisha Toshiba, Kawasaki, Japan

[21] Appl. No.: 259,974

[22] Filed: Jun. 17, 1994

[30] Foreign Application Priority Data

Jun. 21, 1993 [JP] Japan ..... 5-148984

[51] Int. Cl.[6] ..... B65H 31/00

[52] U.S. Cl. ..... 271/209; 271/273

[58] Field of Search ..... 271/209, 188, 271/273, 274

[56] References Cited

U.S. PATENT DOCUMENTS

| | | | |
|---|---|---|---|
| 4,015,703 | 4/1977 | Keller | 271/273 |
| 4,046,372 | 9/1977 | Ebner | 271/273 |
| 4,346,883 | 8/1982 | Speraggi | 271/274 |
| 5,094,660 | 3/1992 | Okuzawa | 271/188 |
| 5,201,424 | 4/1993 | Hain | 271/209 |
| 5,246,224 | 9/1993 | Matsuno | 271/188 |

FOREIGN PATENT DOCUMENTS

| | | | |
|---|---|---|---|
| 144034 | 8/1983 | Japan | 271/274 |
| 62-32061 | 2/1987 | Japan . | |
| 144363 | 6/1990 | Japan | 271/188 |
| 3842 | 1/1991 | Japan | 271/273 |
| 3-101979 | 4/1991 | Japan . | |

*Primary Examiner*—William E. Terrell
*Assistant Examiner*—T. Kelly
*Attorney, Agent, or Firm*—Foley & Lardner

[57] ABSTRACT

A paper sheet transfer apparatus has lower and upper paper-sheet discharge rollers which contact each other and discharge a sheet of paper in accordance with the rotation thereof, and a corrugation roller located in the vicinity of the lower discharge roller. The corrugation roller has a holding portion mounted on the shaft of the lower discharge roller, and a roller main body elastically held by the holding portion and being able to be brought into contact with the sheet of paper. The holding portion and the roller main body are resin-molded integral as one body. By virtue of this structure, the paper sheet transfer apparatus can be assembled at low cost.

16 Claims, 22 Drawing Sheets

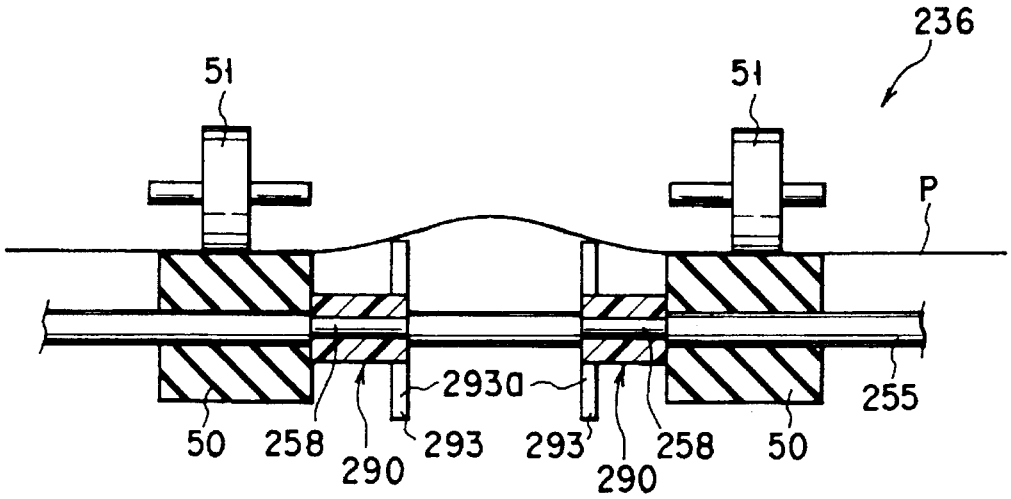
FIG. 65
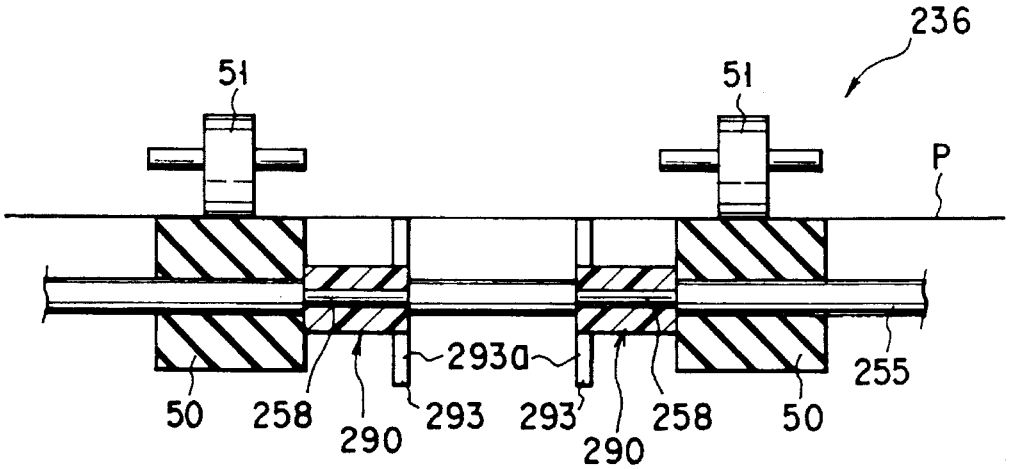
FIG. 66
FIG. 67
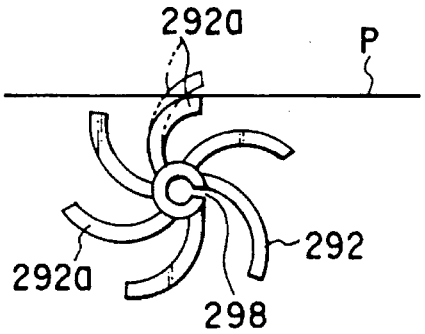

PAPER DISCHARGE UNIT FOR USE IN IMAGE FORMING APPARATUS

BACKGROUND OF THE INVENTION

1. Field of the Invention

This invention relates to a paper transfer mechanism for use in an image forming apparatus for forming a toner image, corresponding to image data, through an electrostatic copying process, and forming the toner image on a sheet of paper.

2. Description of the Related Art

In general, a laser beam printer apparatus, a copying machine or another image forming apparatus has an image forming section for forming a toner image, corresponding to image data, on a sheet of paper, a fixing unit for fixing the toner image formed on the paper sheet, a discharge unit (paper transfer mechanism) for discharging the paper sheet on which the toner image is fixed, and a paper-discharging tray for stacking therein discharged paper sheets.

The discharge unit includes a driving roller unit having a tread surface and a pressing roller unit having a tread surface arranged in contact with that of the driving roller unit. A sheet of paper is transferred to the discharge tray through the roller elements of the roller units.

A sheet, on which a toner image has been fixed by the fixing unit, is usually waved due to heat transmitted from the fixing unit.

Such waved sheets are received inevitably confusedly in the discharge tray, and hence it is possible that sheets are hard to take out of the tray, when they are continuously discharged.

If sheets are greatly waved, a first-discharged sheet may collide with the next-discharged one. As a result, the former may be pushed by the latter and scattered around the tray, or may be inserted between already stacked sheets.

To avoid the above, it has been proposed that a sheet is waved in a direction perpendicular to the direction of transfer. This technique is called "corrugation".

The corrugation is performed by a corrugation roller unit which is formed coaxial with one of the driving roller unit and the pressing roller unit, and has a diameter larger than the roller of the one of the units.

The corrugation roller unit is assembled integral, for example, with the driving roller unit. The number of corrugation rollers employed in the corrugation roller unit and the distance between each adjacent pair of the corrugation rollers are determined on the basis of the size of a paper sheet which can be transferred by the discharge unit.

The corrugation roller unit has a configuration, a structure and a function as disclosed, for example, in Jpn. UM Appln. KOKAI Publication No. 62-32061. FIGS. 6*a* and 6*b* of the publication show corrugation rollers 57*a*, 53*a*, 57*b*, 53*b*, 57*c*, 53*c* and 57*d* which have a diameter larger than transfer rollers 56*a* and 52*a*, and 56*b* and 52*b* (the outer peripheries of the rollers 56*a* and 52*a* (or the rollers 56*b* and 52) contact each other).

In the case of using the corrugation roller unit, however, if a paper sheet is thick, it is possible that each corrugation roller has its track put on the sheet in the direction of transfer.

To avoid this, an improved corrugation roller unit has been proposed, in which the boss of each corrugation roller has a diameter larger than the shaft of the driving roller, and the corrugation roller is attached to the driving roller via a compressed coil spring. The configuration, structure and function of this corrugation roller unit is described in detail, for example, in Jpn. Pat. Appln. KOKAI publication No. 3-101979.

In this corrugation roller unit, if a paper sheet to be discharged is thinner than a predetermined thickness, the outer periphery of the corrugation roller projects from that of the driving roller by means of the compressed coil spring, thereby corrugating the sheet.

In this corrugation roller unit, if the sheet is thicker than the predetermined thickness, the thickness (i.e., hardness) of the sheet pushes back the compressed coil spring and restrains the projection of the outer periphery of the corrugation roller. This enables the sheet to be discharged without the track of the corrugation roller.

This corrugation roller unit, however, has a complicated structure. Therefore, a large number of component parts and a large number of assembling steps are necessary. Inevitably, a great manufacturing cost is required.

SUMMARY OF THE INVENTION

It is an object of the invention to provide a corrugation roller unit capable of discharging a paper sheet with no waves and tracks of rollers.

It is another object of the invention to provide a corrugation roller unit which can be assembled at low cost.

It is a still another object is to provide a corrugation roller unit which has cheap component parts.

According to a first aspect of the invention, there is provided a paper sheet transfer apparatus comprising:

a pair of transfer rollers each having a predetermined diameter opposed to each other for transferring a sheet of paper along a paper sheet transfer plane extend between the pair of transfer rollers by holding the sheet of paper therebetween;

a rotary shaft located coaxial with one of the transfer rollers; and a corrugation roller rotatably mounted on the rotary shaft for corrugating the sheet of paper transferred by the transfer rollers, in a direction perpendicular to the direction of the transfer of the sheet of paper, the corrugation roller having:

a roller main body with a diameter larger than the diameter of each of transfer rollers, for corrugating the sheet of paper, the roller main body projecting from the paper sheet transfer plane toward the other one of the transfer rollers;

a holding portion mounted on the rotary shaft for holding the roller main body on that portion of the rotary shaft which is not opposed to the other one of the transfer rollers; and a support portion extending between the holding portion and the roller main body, the support portion being able to be warped in accordance with the thickness of the sheet of paper transferred by the transfer rollers, for deformably supporting the roller main body, and restraining the amount of projection of the roller main body from the paper sheet transfer plane of the one of the transfer rollers and the amount of the corrugation, the roller main body, the holding portion and the support portion being resin-molded integral as one body.

According to a second aspect of the invention, there is provided a paper sheet transfer apparatus comprising:

transfer roller means including an axial portion and a tread surface having a first radius;

auxiliary roller means including an axial portion and an opposed tread surface having a second radius and opposed to the tread surface having the first diameter, the opposed tread surface being rotated in accordance with the rotation of the transfer roller means; and deformable roller means having a body portion formed integral with one of the axial portions of the transfer roller means and the auxiliary roller means, the body portion giving a sheet material a force exerting in a direction perpendicular to a direction in which the sheet material is transferred between the tread surfaces of the transfer roller means and the auxiliary roller means, the deformable roller means including at least one corrugating portion for giving the force exerting in the direction perpendicular to the direction of the transfer, the at least one corrugating portion including at least one corrugating element which extends around the one of the axial portions, the at least one corrugating element having a outermost surface, the distance between the outermost surface and an axis of the one of the axial portions being larger than the first radius and the second radius, and the outermost surface of the deformable roller means being able to be deformed to have the same level as the tread surface of the one of the axial portions of the transfer roller means and the auxiliary roller means, when the hardness of the sheet material which corresponds to a thickness thereof exceeds a predetermined value.

According to a third aspect of the invention, there is provided a corrugation roller comprising:

a body member mounted on a shaft;

corrugating means having at least one portion, the distance between an outermost surface of the at least one portion and an axis of the shaft being larger than a radius of any one of roller members mounted on the shaft; and connecting means connecting the corrugating means and the body member, and including elastically deformable members which extend parallel to an axis of the shaft, and support members radially extending between the elastically deformable members and the body member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 65 is a schematic sectional view, showing a state of the corrugation roller shown in FIGS. 63 and 64, in which a corrugating function is effected;

FIG. 66 is a schematic sectional view, showing a state of the corrugation roller of FIGS. 63 and 64, in which no corrugation occurs; and FIG. 67 is a right-side view, useful in explaining deformation of the roller in the non-corrugated state shown in FIG. 66.

DETAILED DESCRIPTION OF THE PREFERRED EMBODIMENTS

The embodiments of the present invention will be explained with reference to the accompanying drawings.

Figure 1:
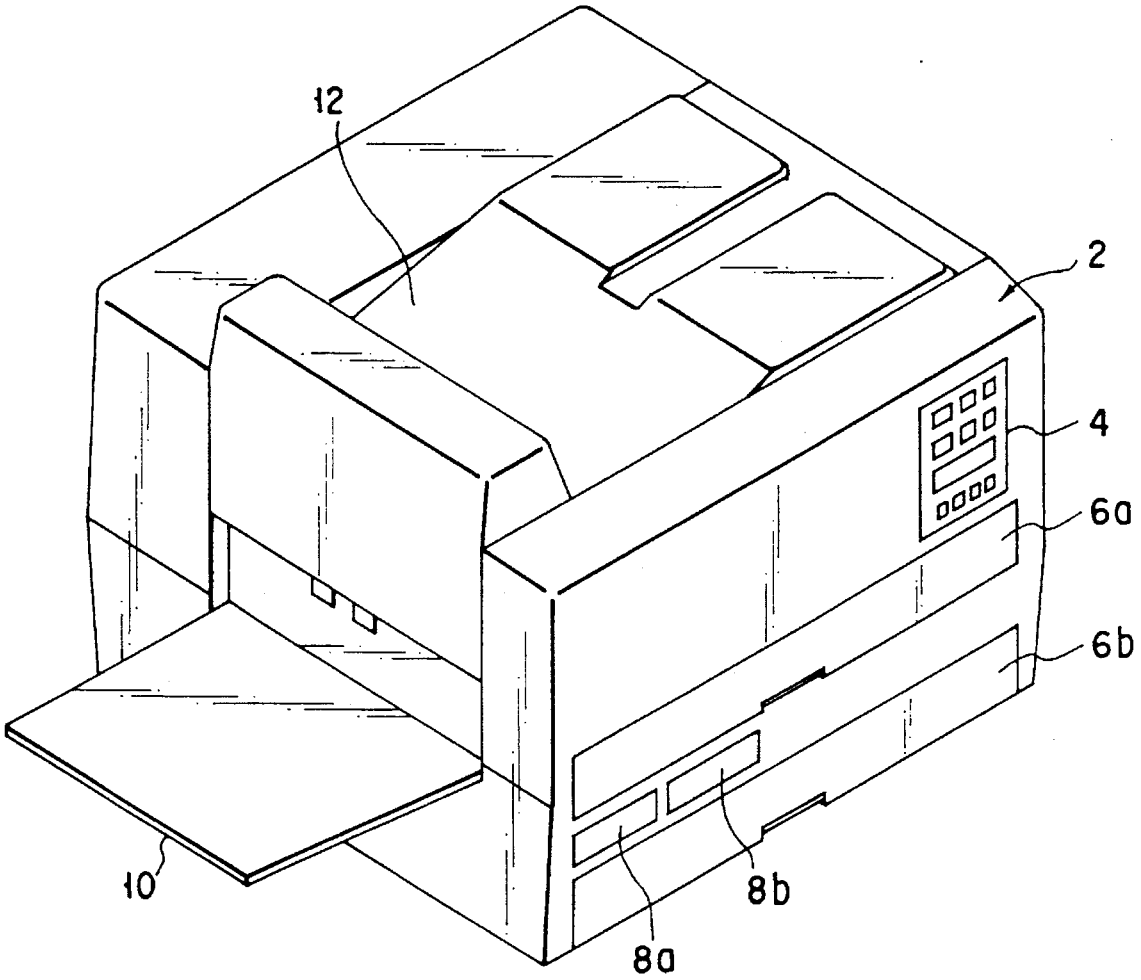
FIG. 1 is a view, showing an example of an image forming apparatus in which a discharge unit of the invention is incorporated.
Figure 2:
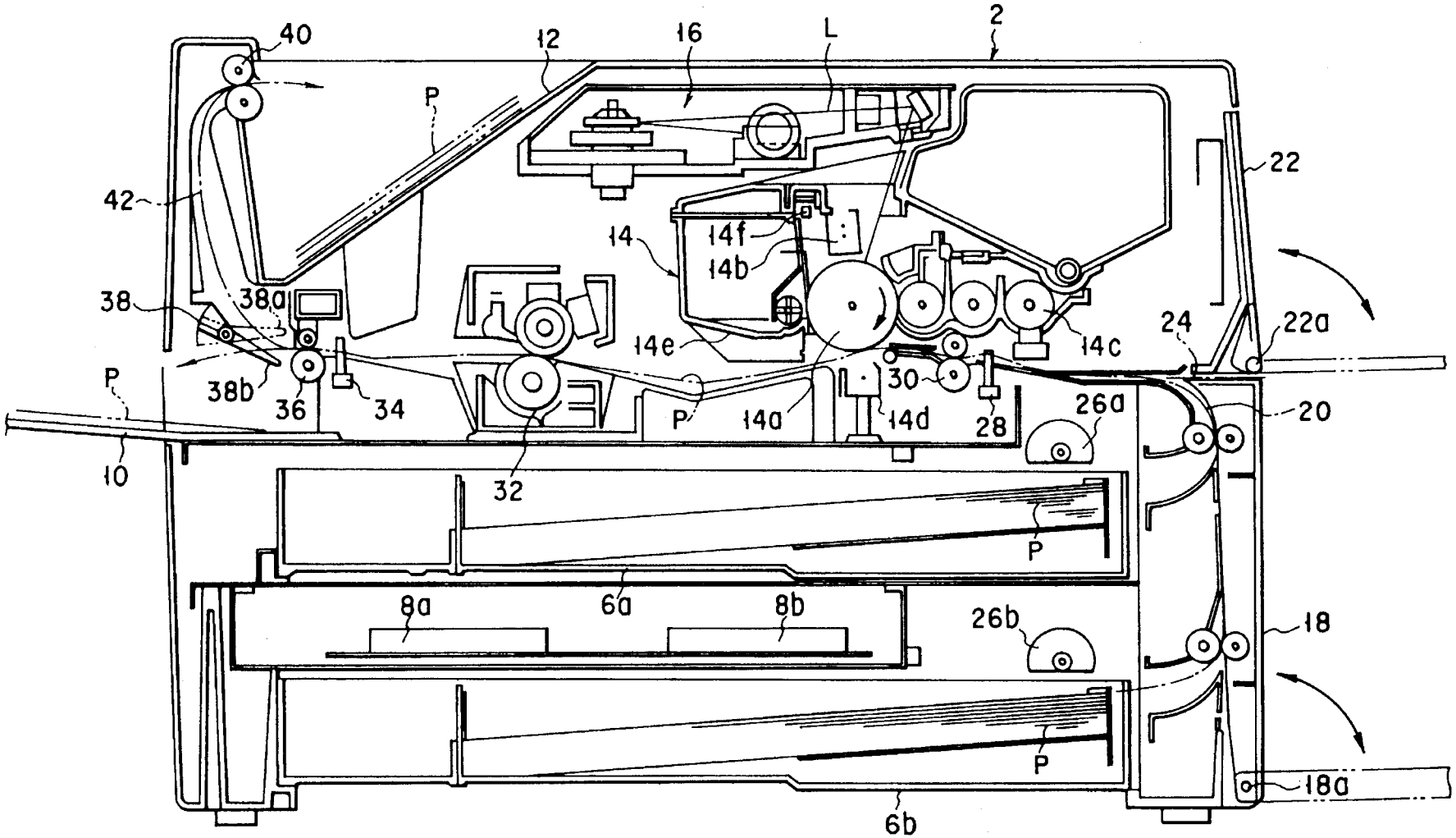
FIG. 2 is a schematic cross sectional view, showing the image forming apparatus of FIG. 1.

FIGS. 1 and 2 show a laser beam printer apparatus (image forming apparatus) in which a discharge unit according to the invention is incorporated.

As is shown in FIG. 1, a laser beam printer apparatus 2 has a front surface provided with an operation panel 4 capable of displaying the operation state of the apparatus 2 and receiving a control signal for manual operation, etc., first and second sheet cassettes 6*a* and 6*b* for supplying paper sheets P (i.e., a medium onto which a toner image is transferred), and extension slots 8*a* and 8*b* into which a function-adding application soft card or an adding font card can be inserted.

The left-side surface of the printer apparatus 2 is provided with a first detachable discharge tray 10 for receiving a sheet P after an image is formed thereon. The tray 10 can be detached by a detaching mechanism (not shown). The sheet P with an image is discharged into the discharge tray 10, with an image-formed surface directed upward (this will be hereinafter called "top-side discharge").

A second discharge tray 12 for receiving a paper sheet P after an image is formed thereon is provided on the upper surface of the apparatus 2 as part of a cover for the same. The sheet P with an image is discharged into the discharge tray 12, with an image-formed surface directed downward (this will be hereinafter called "under-side discharge").

Referring then to FIG. 2, the laser beam printer apparatus 2 has an image forming unit 14 and an exposure unit 16 located above the first and second sheet cassettes 6*a* and 6*b*.

The image forming unit 14 forms a toner image corresponding to image data supplied from an outside unit (not shown), through an electrostatic copying process. The exposure unit 16 emits, onto the image forming unit 14, a laser beam L having its intensity modulated in accordance with image data from the outside unit.

A cylindrical photosensitive drum 14*a* is located at a substantially center portion of the image forming unit 14. The drum 14*a* is rotated at a predetermined speed by means of a motor (not shown) or the like.

A main charging unit 14*b*, a developing unit 14*c*, a transfer charging unit 14*d*, a cleaning unit 14*e* and a pre-lighting unit 14*f*, etc., are located in this order around the drum 14*a* in the direction of rotation thereof.

The main charging unit 14*b* is of a scorotron type, and charges the surface of the drum 14*a* with predetermined electricity. The developing unit 14*c* supplies toner to an electrostatic latent image formed as a result of changing the charge distribution of the charged surface of the drum 14*a* by a laser beam L from the exposure unit 16, thereby forming a toner image on the drum 14*a*. The transfer charging unit 14*d* transfers the toner image from the drum 14*a* to a paper sheet P. The cleaning unit 14*e* removes toner which remains on the drum 14*a* after the toner image is transferred to the sheet P. The pre-lighting unit 14*f* removes remaining charge on the drum 14*a* (the potential of an unexposed portion thereof), and unifies the amount of electricity charged on the drum 14*a* by the charging unit 14*b*. The photosensitive drum 14*a*, the main charging unit 14*b*, the developing unit 14*c*, the transfer charging unit 14*d*, the cleaning unit 14*e* and the pre-lighting unit 14*f* are detachably and compactly attached to the apparatus 2. The laser beam L is emitted from the exposure unit 16 onto the drum 14*a* through a space between the charging unit 14*v* and the developing unit 14*c*.

A cover 18 capable of pivoting on a fulcrum 18*a* to open to the outside is located between the first and second cassettes 6*a* and 6*b* and the image forming unit 14. When closed, the cover 18 provides a supply passage 20 for guiding a paper sheet P taken out of the cassette 6*a* or 6*b* toward the image forming unit 14.

A manual feed guide 22 capable of pivoting on a fulcrum 22*a* to open to the outside is attached at the upper end of the cover 18. A manual feed passage 24 is provided inside the fulcrum 22*a* of the manual feed guide 22 for guiding to the supply passage 20 a paper sheet P supplied via the manual feed guide 22. Paper supply rollers 26*a* and 26*b* are provided at the cassettes 6*a* and 6*b* for taking out paper sheets received therein, respectively.

In a position downstream of the supply passage 20 and immediately upstream of the photosensitive drum 14*a* of the image forming unit 14, there is provided an aligning switch 28 for detecting whether a sheet P has reached a position in the vicinity of and upstream of the transfer charging unit 14*d* (and the drum 14*a*), and there is also provided an aligning roller 30 for temporarily stopping the sheet P and aligning the sheep with a toner image formed on the drum 14*a*.

A fixing unit 32 is located in a direction in which the sheet P with a toner image formed thereon with the use of the photosensitive drum 14*a* and the transfer charging unit 14*d* is transferred (in other words, in a direction in which the sheet is transferred in accordance with the rotation of the drum 12 indicated by the arrow). The fixing unit 32 fixes the toner image on the sheet P by melting the toner thereon and pressing the melted toner.

A paper discharge switch 34 is located in a direction in which the sheet P having passed the fixing unit 32 is guided, for monitoring whether or not the sheet P having passed the fixing unit 32 has been discharged without.

A first discharge unit 36 and a gate unit 38 are located in a direction in which the sheet P is transferred after passing the discharge switch 34.

The first discharge unit 36 forwards the sheet P having passed the discharge switch 34, toward one of the above-described first and second discharge trays 10 and 12.

The gate unit 38 guides the sheet P forwarded by the first discharge unit 36, to one of the first and second discharge trays 10 and 12.

Between the gate unit 38 and the second discharge tray 12, there are provided a second discharge unit 40 and an inverting passage 42 for connecting the gate unit 38 to the second discharge unit 40.

The second discharge unit 40 discharges, into the second discharge tray 12, the sheet P which has been transferred to the inverting passage 42 via the first discharge unit 36 and the gate unit 38. It is a matter of course that the sheet P having been transferred to the second discharge tray 12 via the second discharge unit 40 has its lower and upper sides inverted with respect to the sheet P having been transferred to the first discharge tray 10, since the former passes the inverting passage 42.

The image forming operation of the laser beam printer apparatus 2 will be explained briefly with reference to FIG. 2.

When a print starting signal has been supplied from an outside unit (not shown), a motor (not shown) is operated, thereby rotating the photosensitive drum 14*a* in a direction indicated by the arrow. At the same time, the pre-lighting unit 26 and the charging unit 14*b* are turned on, thereby charging the drum 14*a* with a predetermined potential (surface potential).

Subsequently, the exposure unit 16 radiates a laser beam L having its intensity modulated in accordance with an image signal, onto the drum 14*a* charged with the predetermined surface potential. Thus, an electrostatic latent image corresponding to the image signal is formed on the drum 14*a*.

The electrostatic latent image on the drum 14*a* is visualized by the developing unit 14*c* into a toner image.

By when the drum 14*a* is exposed to the laser beam L, a paper sheet P is transferred from the sheet cassette 6*a* or 6*b* or the manual feed guide 22 to a position near the aligning roller 30. The sheet P is then brought into contact with the roller 30 which is stopped, and is temporarily stopped, thereby removing a skew which may be generated in the sheet P in the direction of the transfer thereof by when it reaches the roller 30.

After removing a skew by the roller 30, the sheet P is again moved at predetermined timing which enables the forward end thereof is aligned with that of a toner image formed on the photosensitive drum 14*a*, and is electrostatically held on the drum 14*a* in a transfer position where the drum 14*a* faces the transfer charging unit 14*d*. In this state, the drum 14*a* is charged with transfer electricity by the transfer charging unit 14*d*, thereby transferring the toner image onto the sheet P.

The toner-transferred sheet P is released from the electrostatic chuck, and then guided to the fixing unit 32 in accordance with the rotation of the drum 14*a*.

The fixing unit 32 melts and presses the toner on the sheet P, to almost permanently fix the toner image thereon.

The toner-fixed sheet P is transferred to the gate unit 38 through the first discharge unit 36. At this time, the gate unit 38 assumes a gate position beforehand selected in accordance with an instruction from a host computer (not shown), and hence the sheet P guided to the gate unit 38 is discharged into the first or the second discharge tray 10 or 12.

More specifically, where the gate unit 38 is in a state 38*a* indicated by the two-dot chain line, the sheet P is discharged into the first discharge tray 10, with its top-side directed upward. On the other hand, where the gate unit 38 is in a state 38*b* indicated by the solid line, the sheet P is discharged into the second discharge tray 12 via the inverting passage 42 and the second discharge unit 40, with its under-side directed upward. The gate unit 38 usually assumes the state 38*b* indicated by the solid line. When the first discharge tray 10 is closed, the gate unit 38 can be disposed to assume the state 38*a* indicated by the two-dot chain line, with the use of a locking mechanism (not shown).

A discharge unit (i.e., a first or second discharge unit 36 or 40) according to a first embodiment of the invention will be explained with reference to FIG. 3.

Since the first and second discharge units 36 and 40 have substantially the same structure, no explanation will be given of the second discharge unit 40.

Figure 3:
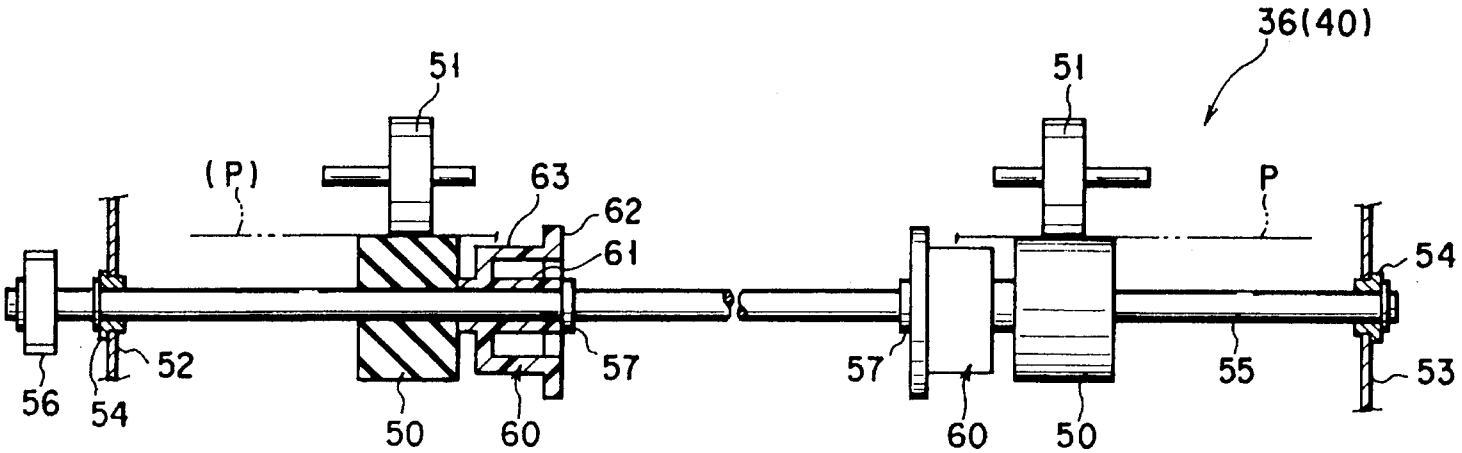
FIG. 3 is a partial cross sectional view, showing a discharge unit incorporated in the image forming apparatus of FIG. 2.

As is shown in FIG. 3, the first discharge unit 36 (the second discharge unit 40) has lower discharge rollers 50, 50 (first discharge rollers) and upper discharge rollers 51, 51 (second discharge rollers) each having a tread surface in contact with that of a corresponding discharge roller 50.

Each of the lower discharge rollers 50, 50 made of a plurality of rubber roller elements. The rollers 50, 50 are fitted on a shaft 55, which is supported by frames 52 and 53 of the apparatus 2 such that it can rotate by means of bearings 54. The rollers 50, 50 are rotated together with the shaft 55. The shaft 55 has an end provided with a gear 56 for receiving a driving force from a driving unit (not shown).

The upper discharge rollers 51, 51 are in press contact with the lower discharge rollers 50, 50 by means of a spring (not shown) or the like, respectively. Corrugation rollers 60 made of a resin of high elasticity are located near the lower discharge rollers 50, 50, respectively.

In accordance with the rotation of the lower discharge rollers 50, 50, the sheet P with a toner image, having passed the fixing unit 32, passes between the lower and upper discharge rollers 50 and 51 from the back side to the front side, the front side being that side of FIG. 3 visible therein.

Referring then to FIGS. 4–8, a corrugation roller suitable to the discharge unit shown in FIG. 3 will be explained.

Figure 5:
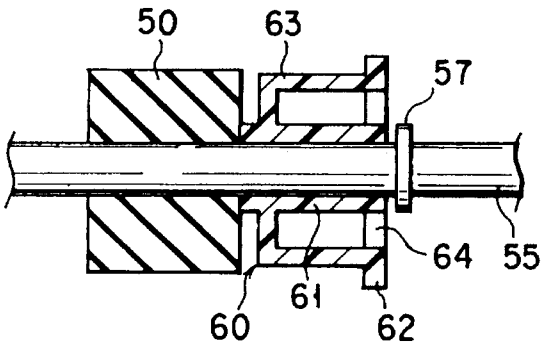
FIG. 5 is a sectional view, showing an essential part of the corrugation roller shown in FIG. 4.
Figure 4:
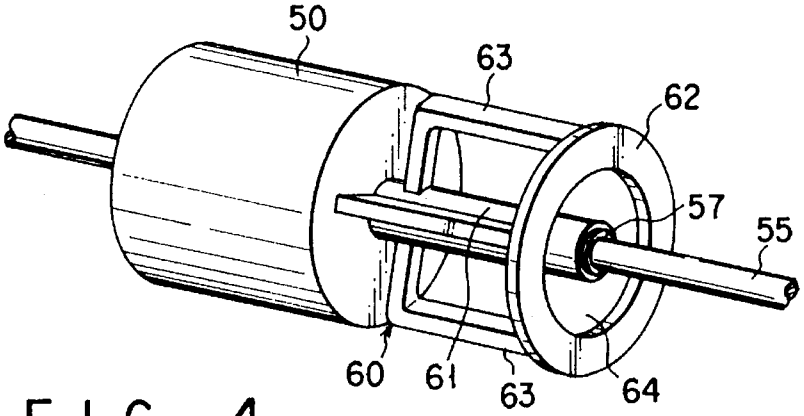
FIG. 4 is a perspective view, showing an essential part of a corrugation roller employed in the discharge unit of FIG. 3.

As is shown in FIGS. 4 and 5, a corrugation roller 60 has a cylindrical holding portion 61 formed coaxially with the shaft 55 fitted on the shaft 55, an annular roller main body 62 formed coaxially with the shaft 55 capable of being brought into contact with the sheet P, and a plurality of elastic support arm portions 63 formed coaxially with the shaft 55, . . . , etc. The holding portion 61, the roller main body 62 and the support arm portions 63 . . . are resin-molded integral as one body.

A space 64 is defined between the roller main body 62 and the holding portion 61 (shaft 55), for allowing the elastic support arm portions 63, . . . to elastically deform to change the position of the roller main body 62 when a force larger than a predetermined value has been applied thereto, for example, when the thickness (or hardness) of a sheet P exceeds a predetermined value. The roller main body 62 has a diameter larger at least than the lower discharge rollers 50.

As is evident from FIG. 3, there are provided at least two corrugation rollers 60, 60. The number of corrugation rollers employed and the interval therebetween can be determined depending upon the size of a sheet P to be transferred by the discharge unit 36 (40). Further, each of the corrugation rollers 60, 60 is fixed on the shaft 55 by a C-shaped ring 57, with a predetermined distance from a corresponding lower discharge roller 50, so that the roller main body 62 cannot collide with the upper discharge roller 51.

Figure 6:
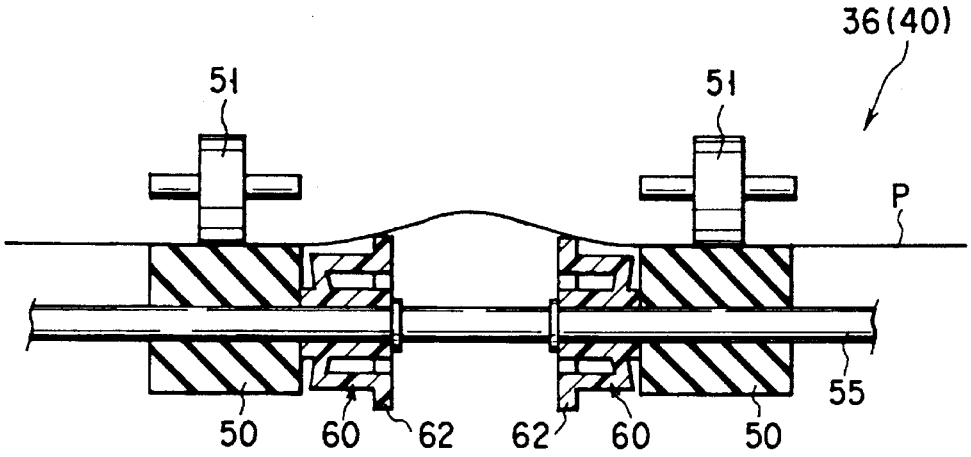
FIG. 6 is a schematic sectional view, showing a state of the corrugation roller of FIGS. 4 and 5, in which a corrugating function is effected.
Figure 7:
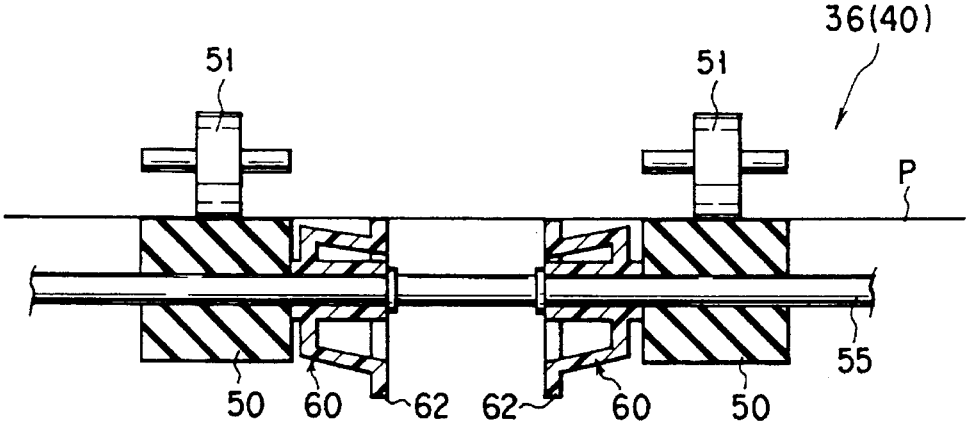
FIG. 7 is a schematic sectional view, showing a state of the corrugation roller of FIGS. 4 and 5, in which no corrugation occurs.

FIGS. 6 and 7 are cross sectional views, useful in explaining the function of the discharge unit 36 (40) having the corrugation rollers 60, 60.

As is shown in FIG. 6, when the sheet P passes between the lower and upper discharge rollers 50, 50 and 51, 51, it is corrugated toward a center portion of the shaft 55 by the corrugation rollers 60, 60 (which have a diameter larger than the lower discharge rollers 50, 50, and hence project therefrom). As a result, the sheet P is discharged into the first discharge tray 10 after the waves which are formed on the sheet when it is heated by the fixing unit 32 are removed.

On the other hand, when the sheet P is thicker than a predetermined thickness, the elastic support arm portions 63, . . . are elastically deformed by the pressing force of the thick sheet, with the result that the roller main body 62 is deformed downward, as is shown in FIG. 7.

Figure 8:
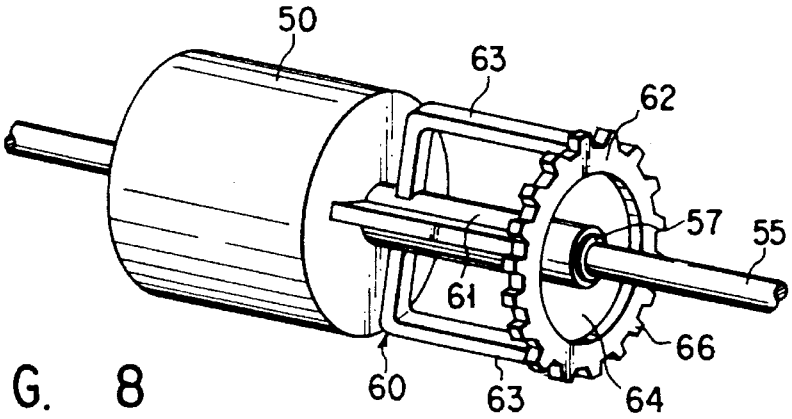
FIG. 8 is a perspective view, showing a modification of the corrugation roller shown in FIGS. 4 and 5.

FIG. 8 shows a modification of the corrugation roller shown in FIGS. 4 and 5.

As is shown in FIG. 8, the roller main body 62 of the corrugation roller 60 has a plurality of projections 66 formed at the periphery thereof at regular intervals. The projections 66 enable reliable transfer (discharge) of the sheet P between the rollers 50 and 51.

Referring then to FIGS. 9–14, a corrugation roller according to a second embodiment will be explained. Since the discharge unit 36 (40) which incorporates the corrugation roller has substantially the same structure as that shown in FIG. 3, like elements are denoted by like reference numerals, and no detailed explanation will be given thereof.

Figure 9:
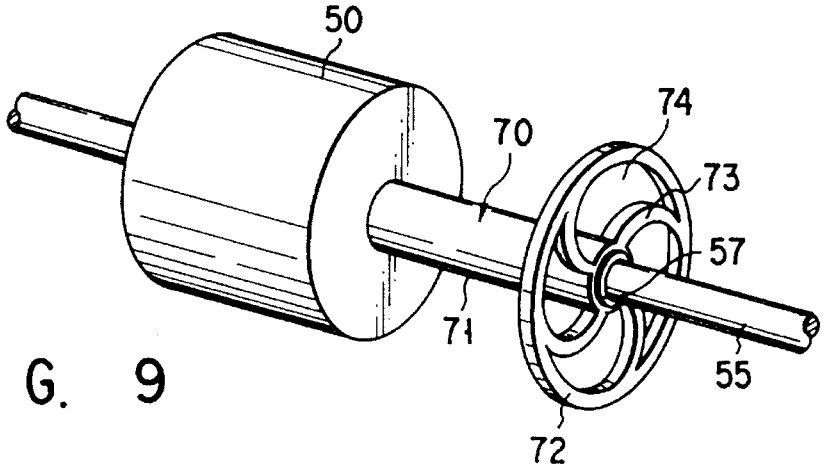
FIG. 9 is a perspective view, showing an essential part of a corrugation roller employed in the discharge unit of FIG. 3 and according to a second embodiment of the invention.
Figure 10A:
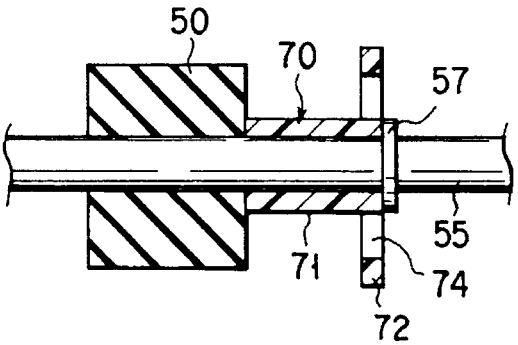
FIGS. 10A and 10B are a partial cross sectional view and a right-side view of an essential part of the 10 corrugation roller shown in FIG. 9.
Figure 10B:
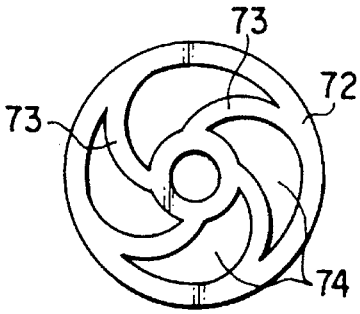

As is shown in FIGS. 9 and 10, a corrugation roller 70 has a cylindrical holding portion 71 fitted on the shaft 55, an annular roller main body 72 capable of being brought into contact with the sheet P, and a plurality of elastic support arm portions 73 each of which extends radially and curved between the portion 71 and the body 72, thereby connecting them. As in the case of the first embodiment shown in FIGS. 4 and 5, the holding portion 71, the roller main body 72 and the support arm portions 73 . . . are resin-molded integral as one body.

A plurality of spaces 74 are defined between the roller main body 72 and the holding portion 71 (shaft 55), for allowing the elastic support arm portions 73, . . . to elastically deform to change the position of the roller main body 72 when a force larger than a predetermined value has been applied thereto, for example, when the thickness (or hardness) of a sheet P exceeds a predetermined value. The roller main body 72 has a diameter larger than the lower discharge rollers 50.

Figure 11:
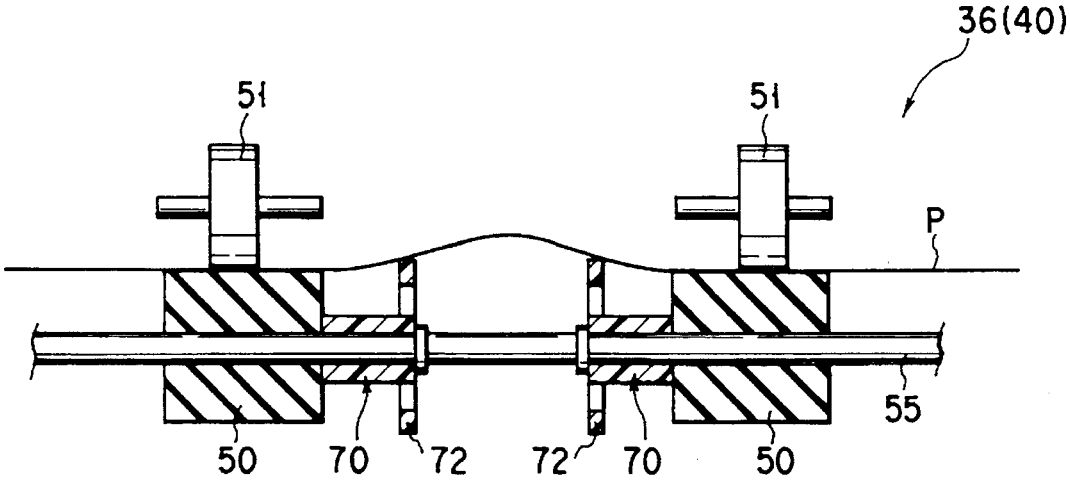
FIG. 11 is a schematic sectional view, showing a state of the corrugation roller of FIGS. 9 and 10, in which a corrugating function is effected.

As is shown in FIG. 11, when the sheet P passes between the lower and upper discharge rollers 50, 50 and 51, 51, it is corrugated toward a center portion of the shaft 55 by the corrugation rollers 70, 70 (which have a diameter larger than the lower discharge rollers 50, 50, and hence project therefrom). As a result, the sheet P is discharged into the first discharge tray 10 after the waves which are formed on the sheet when it is heated by the fixing unit 32 are removed.

Figure 12:
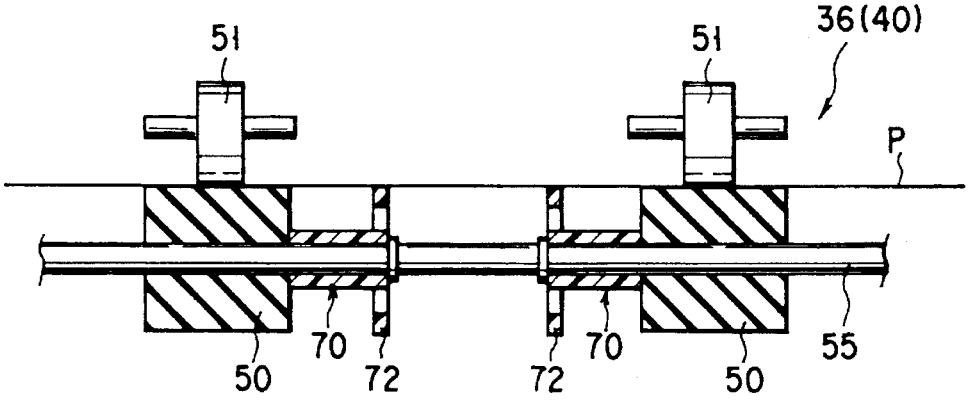
FIG. 12 is a schematic sectional view, showing a state of the corrugation roller of FIGS. 9 and 10, in which no corrugation occurs.
Figure 13:
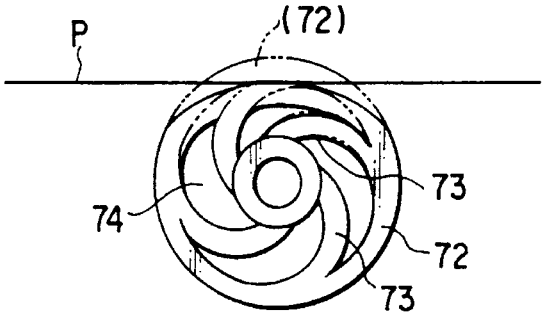
FIG. 13 is a right-side view, useful in explaining deformation of the roller in the non-corrugated state shown in FIG. 12.

On the other hand, when the sheet P is thicker than a predetermined thickness, the elastic support arm portions 73 are elastically deformed by the pressing force of the thick sheet, with the result that the roller main body 72 is deformed downward, as is shown in FIGS. 12 and 13.

Figure 14:
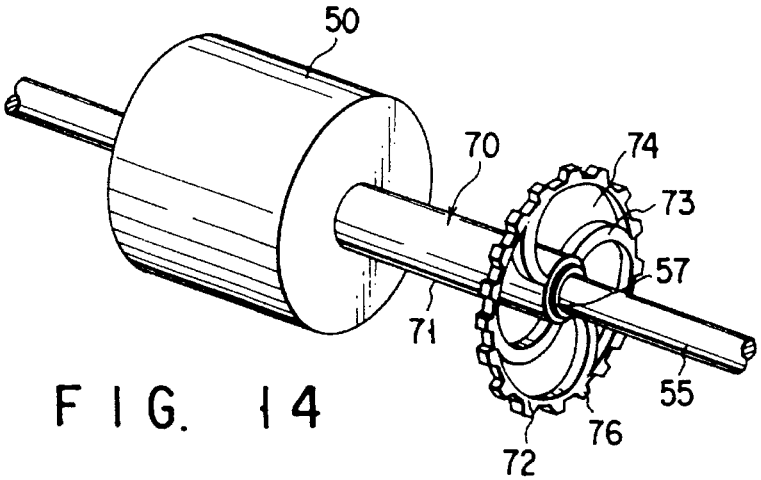
FIG. 14 is a perspective view, showing a modification of the corrugation roller shown in FIGS. 9 and 10.

FIG. 14 shows a modification of the corrugation roller shown in FIGS. 9 and 10.

As is shown in FIG. 14, the roller main body 72 of the corrugation roller 70 has a plurality of projections 76 formed at the periphery thereof at regular intervals. The projections 76 enable reliable transfer (discharge) of the sheet P between the rollers 50 and 51.

Referring now to FIGS. 15–18, a corrugation roller according to a third embodiment will be explained. Since the discharge unit 36 (40) which incorporates the corrugation roller has substantially the same structure as those employed in the above-described embodiments, like elements are denoted by like reference numerals, and no detailed explanation will be given thereof.

Figure 15:
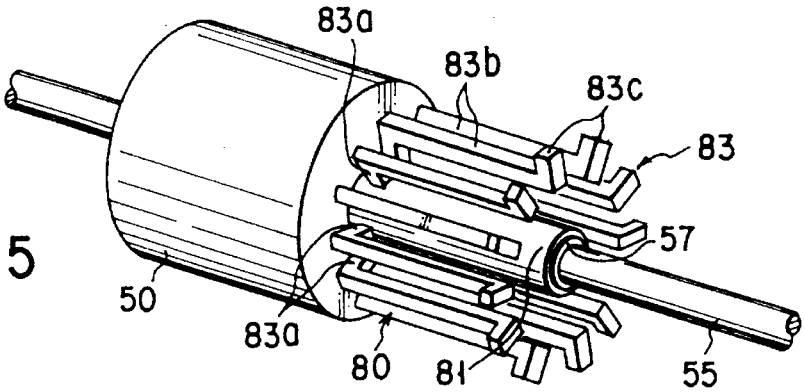
FIG. 15 is a perspective view, showing an essential part of a corrugation roller employed in the discharge unit of FIG. 3 and according to a third embodiment of the invention.
Figure 16A:
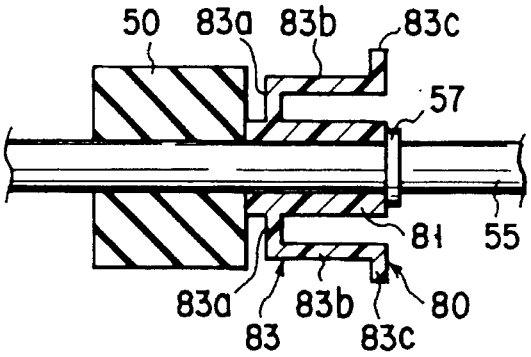
FIGS. 16A and 16B are a partial cross sectional view and a right-side view of an essential part of the corrugation roller shown in FIG. 15.
Figure 16B:
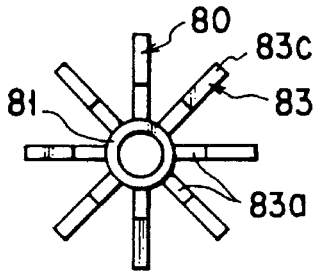

As is shown in FIGS. 15 and 16, a corrugation roller 80 has a cylindrical holding portion 81 fitted on the shaft 55, and a plurality of elastic support arm portions 83 each of which radially extends from the holding portion 81.

Each of the elastic support arm portions 83 has a leg portion 83*a* radially extending from the holding portion 81, an elastic arm 83*b* extending parallel to the holding portion 81, and a projection 83*c* projecting from the elastic arm 83*b* in a direction remote from the holding portion 81 (shaft 55).

The diameter of an imaginary circle formed by connecting the distal end surfaces of the projections 83*c* is set larger at least than that of the lower discharge roller 50 of the discharge unit 36 (40).

Further, as in the above-described embodiments, the holding portion 81 and the elastic support arm portions 83 . . . of the corrugation roller 80 are resin-molded integral as one body.

If each elastic support arm portion 83 has an optimal configuration, the corrugation roller 80 can be made such that only the distance between the elastic arm 83*b* and the holding portion 81 (shaft 55) is varied in accordance with the amount of force applied thereto.

Figure 17:
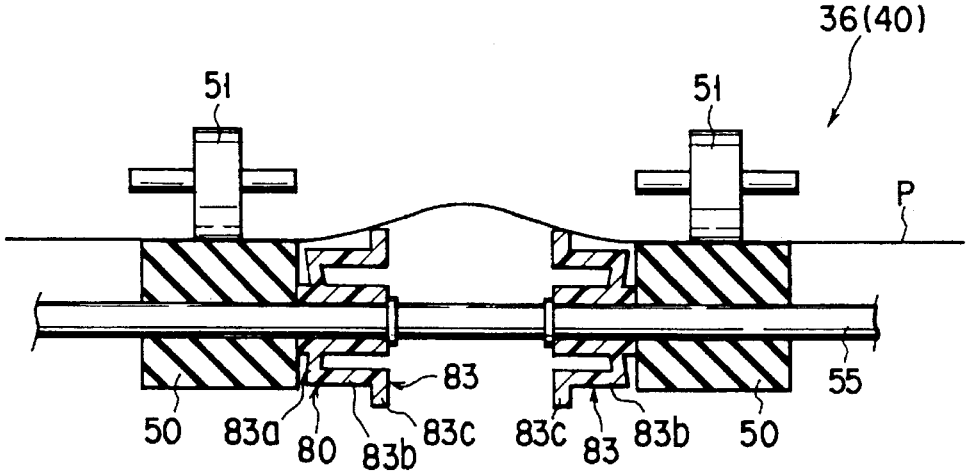
FIG. 17 is a schematic sectional view, showing a state of the corrugation roller of FIGS. 15 and 16, in which a corrugating function is effected.
Figure 18:
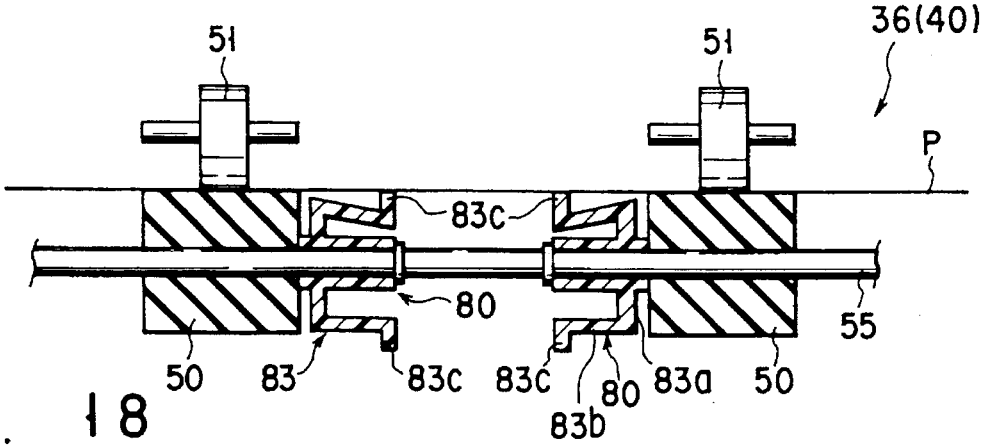
FIG. 18 is a schematic sectional view, showing a state of the corrugation roller of FIGS. 15 and 16, in which no corrugation occurs.

FIGS. 17 and 18 are cross sectional views, useful in explaining the function of the discharge unit 36 (40) having the corrugation rollers 80, 80.

As is shown in FIG. 17, when the sheet P passes between the lower and upper discharge rollers 50, 50 and 51, 51, it is corrugated toward a center portion of the shaft 55 by the corrugation rollers 80, 80. As a result, the sheet P is discharged into the first discharge tray 10 after the waves which are formed on the sheet when it is heated by the fixing unit 32 are removed.

On the other hand, when the sheet P is thicker than a predetermined thickness, the elastic arms 83*b* of the elastic support arm portions 83 are elastically deformed by the pressing force of the thick sheet, with the result that the projections 83*c* are displaced downward, as is shown in FIG. 18.

FIGS. 19–23 show a corrugation roller according to a fourth embodiment. Since the discharge unit 36 (40) which incorporates the corrugation roller has substantially the same structure as that shown in FIG. 3, like elements are denoted by like reference numerals, and no detailed explanation will be given thereof.

Figure 19:
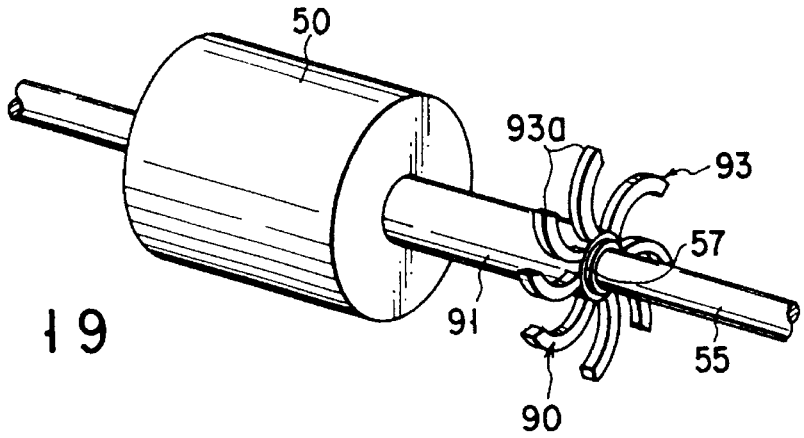
FIG. 19 is a perspective view, showing an essential part of a corrugation roller employed in the discharge unit of FIG. 3 and according to a fourth embodiment of the invention.
Figure 20A:
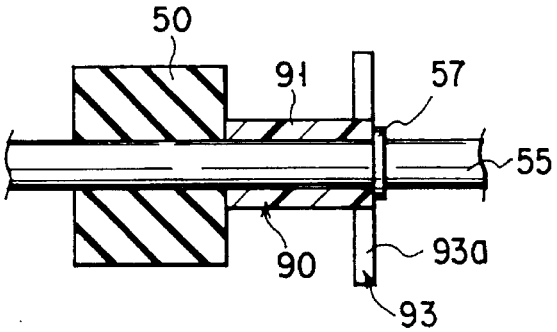
FIGS. 20A and 20B are a partial cross sectional view and a right-side view of an essential part of the corrugation roller shown in FIG. 19.
Figure 20B:
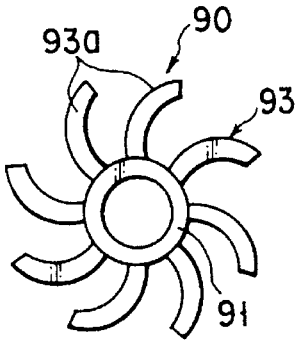

As is shown in FIGS. 19 and 20, a corrugation roller 90 has a cylindrical holding portion 91 fitted on the shaft 55, and a plurality of elastic support arm portions 93 each of which radially extends from the holding portion 91.

Each of the elastic support arm portions 93 consists of a curved arm 93*a* extending radially from the holding portion 91.

The diameter of an imaginary circle formed by connecting the distal end surfaces of the arms 93*a* is set larger at least than that of the lower discharge roller 50 of the discharge unit 36 (40).

Further, as in the above-described embodiments, the holding portion 91 and the elastic support arm portions 93 . . . of the corrugation roller 90 are resin-molded integral as one body.

Figure 21:
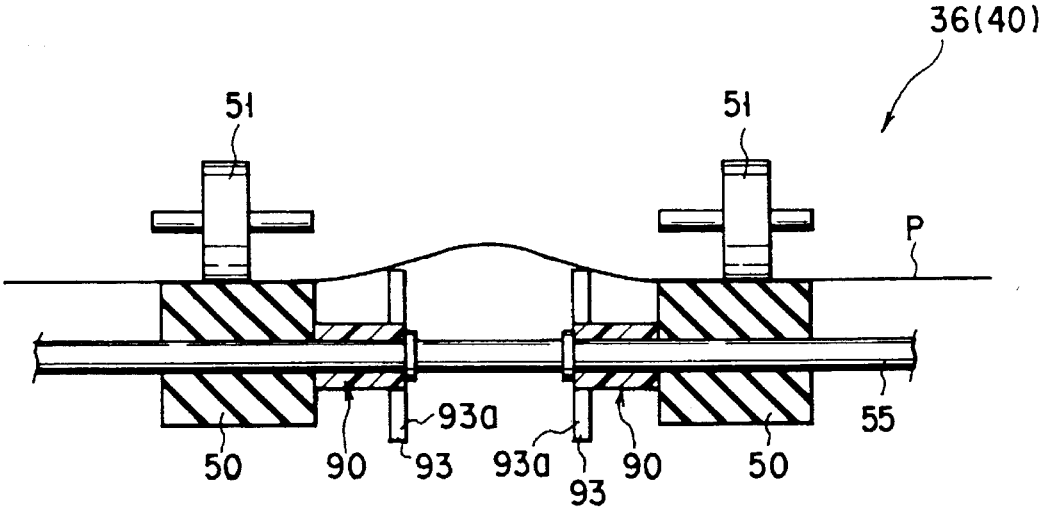
FIG. 21 is a schematic sectional view, showing a state of the corrugation roller of FIGS. 19 and 20, in which a corrugating function is effected.
Figure 22:
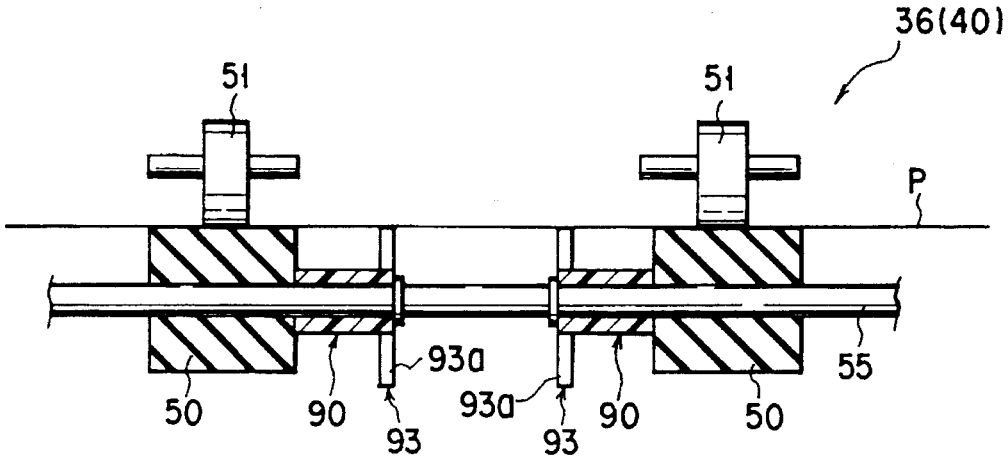
FIG. 22 is a schematic sectional view, showing a state of the corrugation roller of FIGS. 19 and 20, in which no corrugation occurs.

FIGS. 21 and 22 are cross sectional views, useful in explaining the function of the discharge unit 36 (40) having the corrugation rollers 90, 90.

As is shown in FIG. 21, when the sheet P passes between the lower and upper discharge rollers 50, 50 and 51, 51, it is corrugated toward a center portion of the shaft 55 by the corrugation rollers 90, 90. As a result, the sheet P is discharged into the first discharge tray 10 after the waves which are formed on the sheet when it is heated by the fixing unit 32 are removed.

Figure 23:
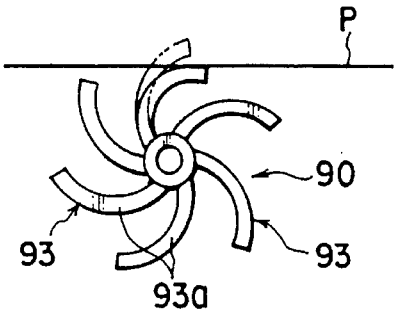
FIG. 23 is a right-side view, useful in explaining deformation of the roller in the non-corrugated state shown in FIG. 22.

On the other hand, when the sheet P is thicker than a predetermined thickness, the elastic arms 93*a* of the elastic support arm portions 93 are elastically deformed and warped downward by the pressing force of the thick sheet, as is shown in FIGS. 22 and 23.

Referring to FIGS. 24–28, a corrugation roller according to a fifth embodiment will be explained. Since the discharge unit 36 (40) which incorporates the corrugation roller has substantially the same structure as those employed in the above-described embodiments, like elements are denoted by like reference numerals, and no detailed explanation will be given thereof.

Figure 25:
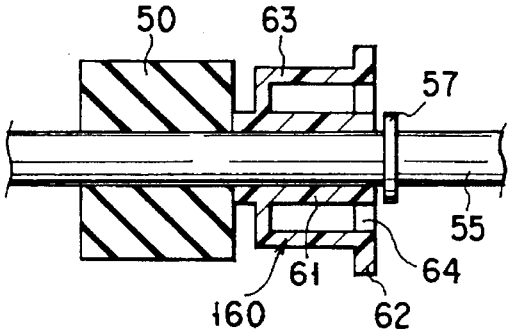
FIG. 25 is a cross sectional view, showing an essential part of the corrugation roller of FIG. 24.
Figure 24:
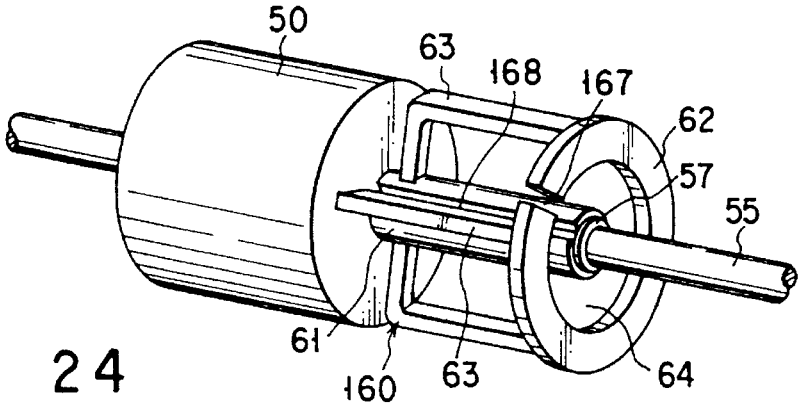
FIG. 24 is a perspective view, showing an essential part of a corrugation roller employed in the discharge unit of FIG. 3 and according to a fifth embodiment of the invention.

As is shown in FIGS. 24 and 25, a corrugation roller 160 has the cylindrical holding portion 61 fitted on the shaft 55, the annular roller main body 62 capable of being brought into contact with the sheet P, and a plurality of elastic support arm portions 63, . . . , etc. The holding portion 61 and the roller main body 62 have slits 167 and 168 formed in the axial direction of the shaft 55, respectively. The holding portion 61, the roller main body 62 and the support arm portions 63 . . . are resin-molded integral as one body. The slits 167 and 168 enable the corrugation roller 160 to be opened in the circumferential direction. Thus, the roller 160 can be brought into contact with the shaft 55 in a direction perpendicular to the axis of the shaft 55, and be mounted thereon.

Figure 26:
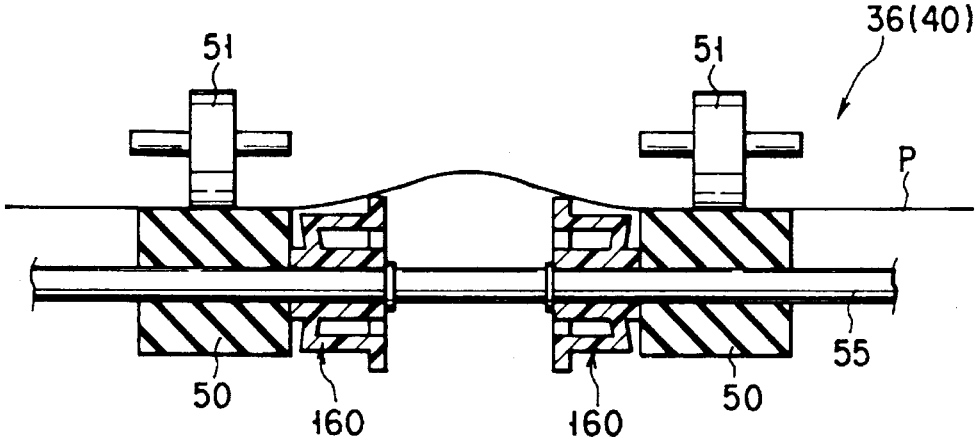
FIG. 26 is a schematic sectional view, showing a state of the corrugation roller of FIGS. 24 and 25, in which a corrugating function is effected.
Figure 27:
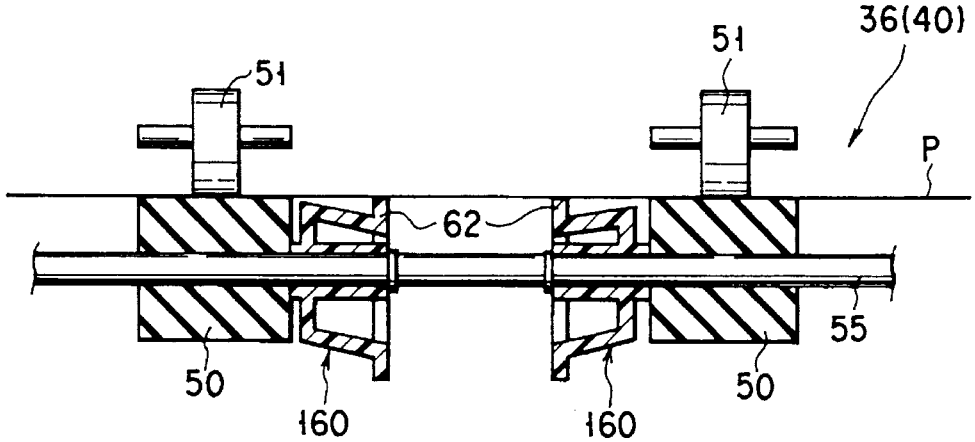
FIG. 27 is a schematic sectional view, showing a state of the corrugation roller of FIGS. 24 and 25, in which no corrugation occurs.

FIGS. 26 and 27 are cross sectional views, useful in explaining the function of the discharge unit 36 (40) having the corrugation rollers 160, 160.

As is shown in FIG. 26, when the sheet P passes between the lower and upper discharge rollers 50, 50 and 51, 51, it is corrugated toward a center portion of the shaft 55 by the corrugation rollers 160, 160. As a result, the sheet P is discharged into the first discharge tray 10 after the waves which are formed on the sheet when it is heated by the fixing unit 32 are removed.

On the other hand, when the sheet P is thicker than a predetermined thickness, the elastic support arm portions 63 . . . are elastically deformed by the pressing force of the thick sheet, with the result that the roller main body 62 is deformed downward, as is shown in FIG. 27.

Figure 28:
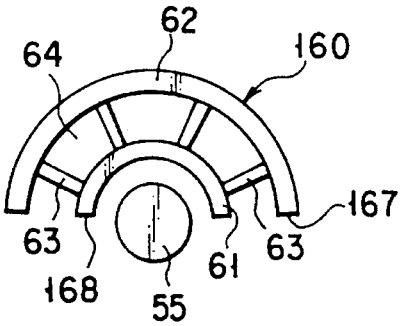
FIG. 28 is a schematic side view, useful in explaining a manner for mounting the corrugation roller shown in FIGS. 24 and 25, on a shaft.

FIG. 28 is a schematic side view, useful in more clarifying a method for mounting on the shaft 55 the corrugation roller shown in FIGS. 24 and 25.

Figure 29:
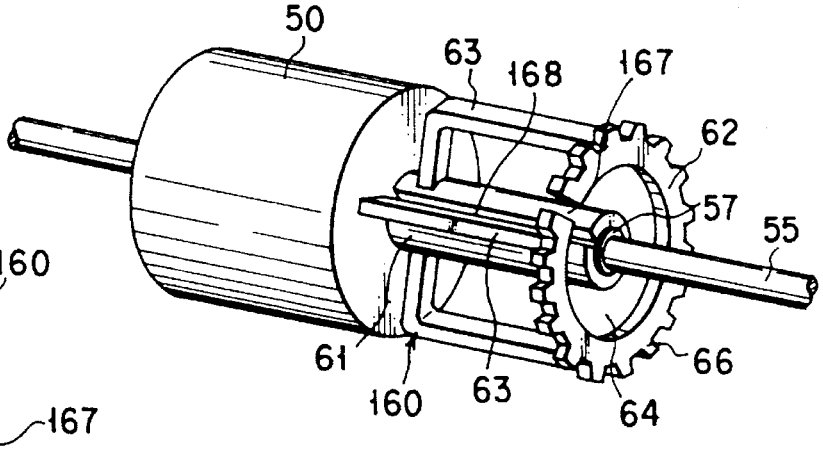
FIG. 29 is a perspective view, showing a modification of the corrugation roller shown in FIGS. 24 and 25.

FIG. 29 shows a modification of the corrugation roller shown in FIGS. 24 and 25.

As is shown in FIG. 29, the roller main body 62 of the corrugation roller 160 has a plurality of projections 66 formed at the periphery thereof at regular intervals. The projections 66 enable reliable transfer (discharge) of the sheet P between the rollers 50 and 51.

Referring then to FIGS. 30–35, a corrugation roller according to a sixth embodiment will be explained. Since the discharge unit 36 (40) which incorporates the corrugation roller has substantially the same structure as that shown in FIG. 3, like elements are denoted by like reference numerals, and no detailed explanation will be given thereof.

Figure 30:
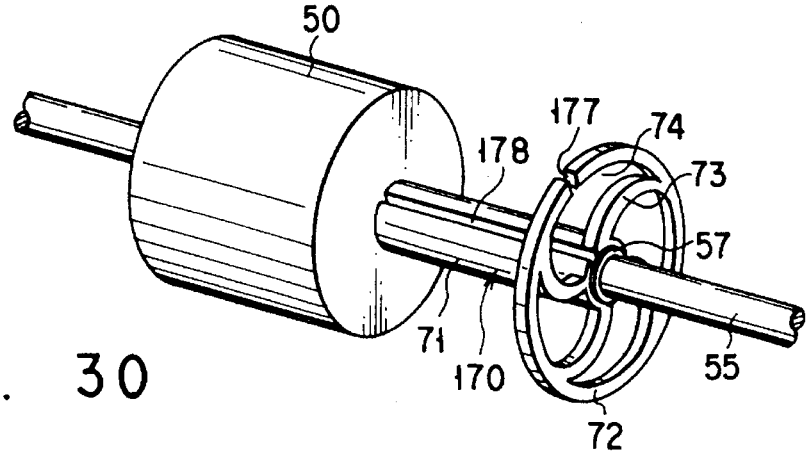
FIG. 30 is a perspective view, showing an essential part of a corrugation roller employed in the discharge unit of FIG. 3 and according to a sixth embodiment of the invention.
Figure 31A:
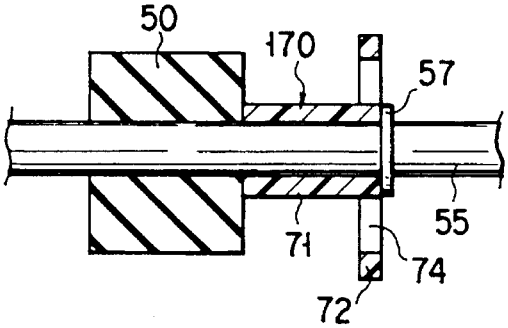
FIGS. 31A and 31B are a partial cross sectional view and a right-side view of an essential part of the corrugation roller shown in FIG. 30.
Figure 31B:
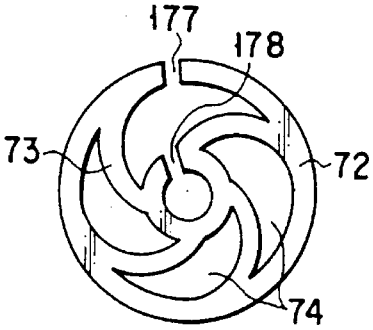

As is shown in FIGS. 30 and 31, a corrugation roller 170 has a cylindrical holding portion 71 fitted on the shaft 55, an annular roller main body 72 capable of being brought into contact with the sheet P, and a plurality of elastic support arm portions 73 each of which extends radially and curved between the holding portion 71 to the body 72, thereby connecting them. The holding portion 71 and the roller main body 72 respectively have slits 177 and 178 formed therein. As in some of the above-described embodiments, the holding portion 71, the roller main body 72 and the support arm portions 73 . . . are resin-molded integral as one body.

The slits 177 and 178 enable the corrugation roller 170 to be opened in the circumferential direction. Thus, the roller 170 can be brought into contact with the shaft 55 in a direction perpendicular to the axis of the shaft, and be mounted thereon.

Figure 32:
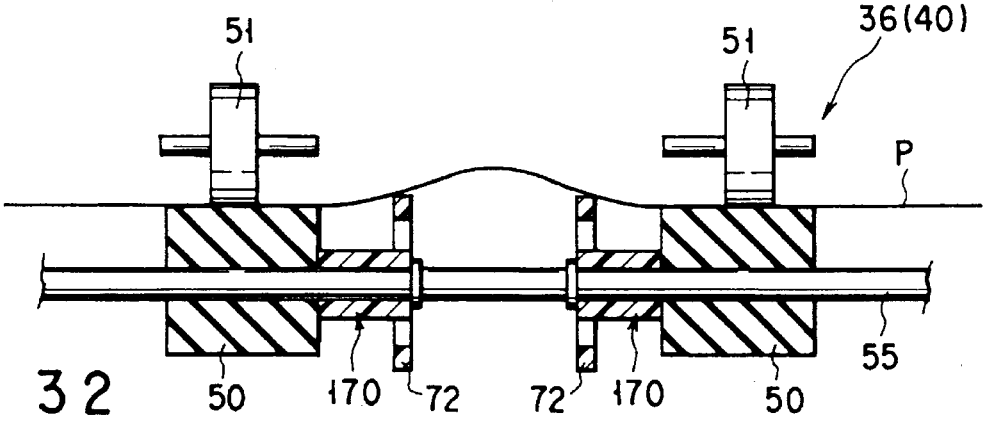
FIG. 32 is a schematic sectional view, showing a state of the corrugation roller of FIGS. 30 and 31, in which a corrugating function is effected.
Figure 33:
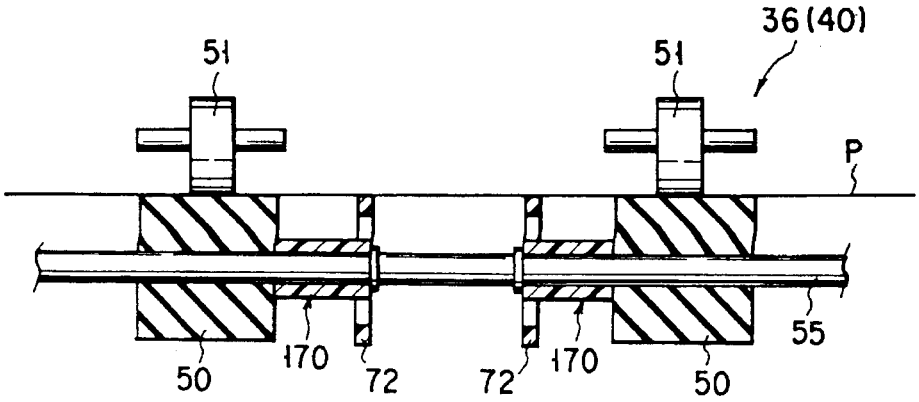
FIG. 33 is a schematic sectional view, showing a state of the corrugation roller of FIGS. 30 and 31, in which no corrugation occurs.

FIGS. 32 and 33 are cross sectional views, useful in explaining the function of the discharge unit 36 (40) having the corrugation rollers 170, 170.

As is shown in FIG. 32, when the sheet P passes between the lower and upper discharge rollers 50, 50 and 51, 51, it is corrugated toward a center portion of the shaft 55 by the corrugation rollers 60, 60 (which have a diameter larger than the lower discharge rollers 50, 50, and hence project therefrom). As a result, the sheet P is discharged into the first discharge tray 10 after the waves which are formed on the sheet when it is heated by the fixing unit 32 are removed.

Figure 34:
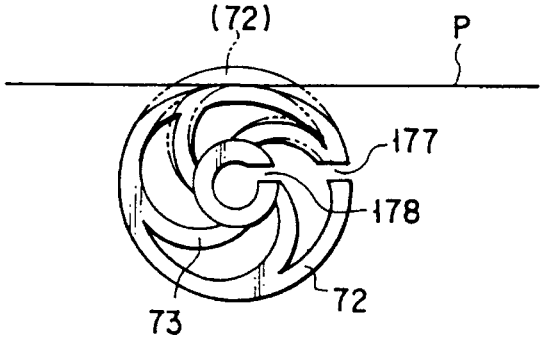
FIG. 34 is a right-side view, useful in explaining the deformation of the roller in the non-corrugated state shown in FIG. 33.

On the other hand, when the sheet P is thicker than a predetermined thickness, the elastic support arm portions 73 . . . are elastically deformed by the pressing force of the thick sheet, with the result that the roller main body 72 is deformed downward, as is shown in FIGS. 33 and 34.

Figure 35:
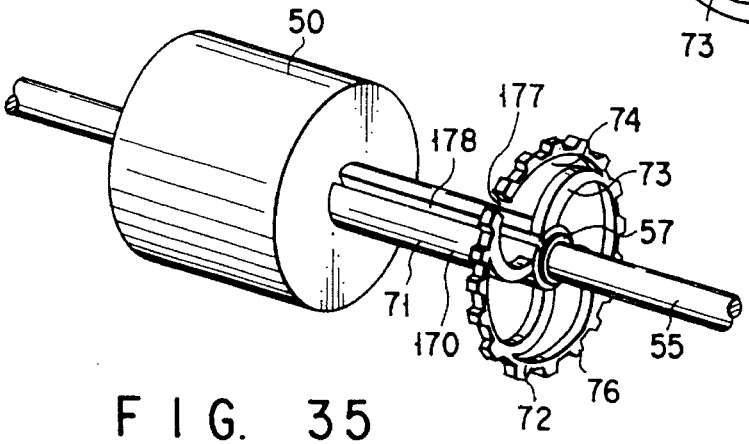
FIG. 35 is a perspective view, showing a modification of the corrugation roller shown in FIGS. 30 and 31.

FIG. 35 shows a modification of the corrugation roller shown in FIGS. 30 and 31.

As is shown in FIG. 35, the roller main body 72 of the corrugation roller 170 has a plurality of projections 76 formed at the periphery thereof at regular intervals. The projections 76 enable reliable transfer (discharge) of the sheet P between the rollers 50 and 51.

Referring then to FIGS. 36–40, a corrugation roller according to a seventh embodiment will be explained. Since the discharge unit 36 (40) which incorporates the corrugation roller has substantially the same structure as that shown in FIG. 3, like elements are denoted by like reference numerals, and no detailed explanation will be given thereof.

Figure 36:
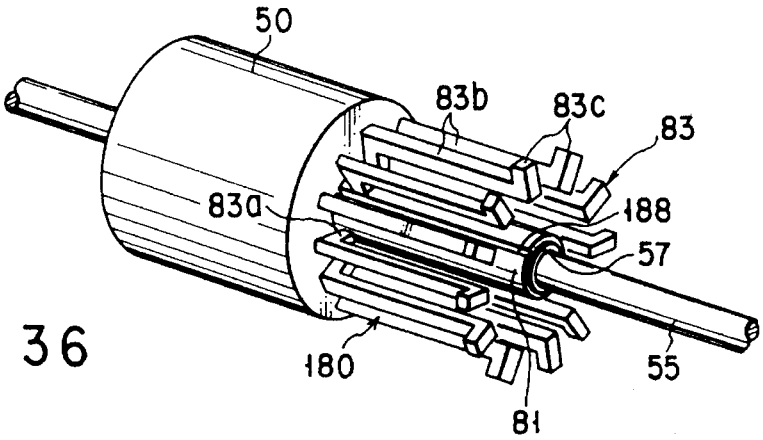
FIG. 36 is a perspective view, showing an essential part of a corrugation roller employed in the discharge unit of FIG. 3 and according to a seventh embodiment of the invention.
Figure 37A:
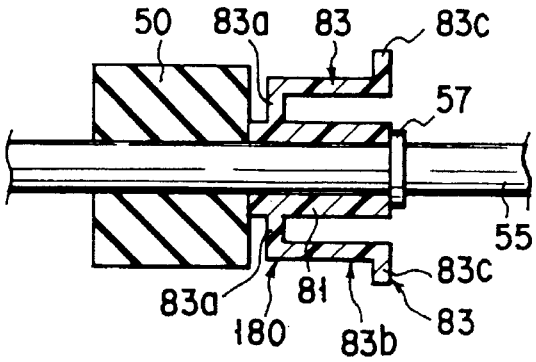
FIGS. 37A and 37B are a partial cross sectional view and a right-side view of an essential part of the corrugation roller shown in FIG. 36.
Figure 37B:
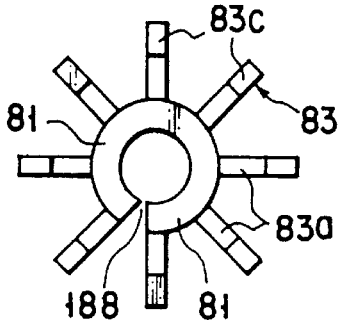

As is shown in FIGS. 36 and 37, a corrugation roller 180 has a cylindrical holding portion 81 fitted on the shaft 55, and a plurality of elastic support arm portions 83 each of which radially extends from the holding portion 81.

Each of the elastic support arm portions 83 has a leg portion **83*a* radially extending from the holding portion 81, an elastic arm 83*b* extending parallel to the holding portion 81, and a projection 83*c* projecting from the elastic arm 83*b* in a direction remote from the holding portion 81 (shaft 55). If each elastic support arm portion 83 has an optimal configuration, the corrugation roller 180 can be made such that only the distance between the elastic arm 83*b* and the holding portion 81 (shaft 55) is varied in accordance with the amount of force applied thereto. The diameter of an imaginary circle formed by connecting the distal end surfaces of the projections 83*c* is set larger at least than that of the lower discharge roller 50 of the discharge unit 36 (40). The holding portion 81 has a slit 188 extending in the axial direction of the shaft 55. Further, as in the above-described embodiments, the holding portion 81 and the elastic support arm portions 83 . . . of the corrugation roller 180 are resin-molded integral as one body. The slit 188 enables the corrugation roller 180 to be developed in a circumferential direction. Thus, the corrugation roller 180 can be brought into contact with the shaft 55** in a direction perpendicular to the axis of the shaft, and be mounted thereon.

Figure 38:
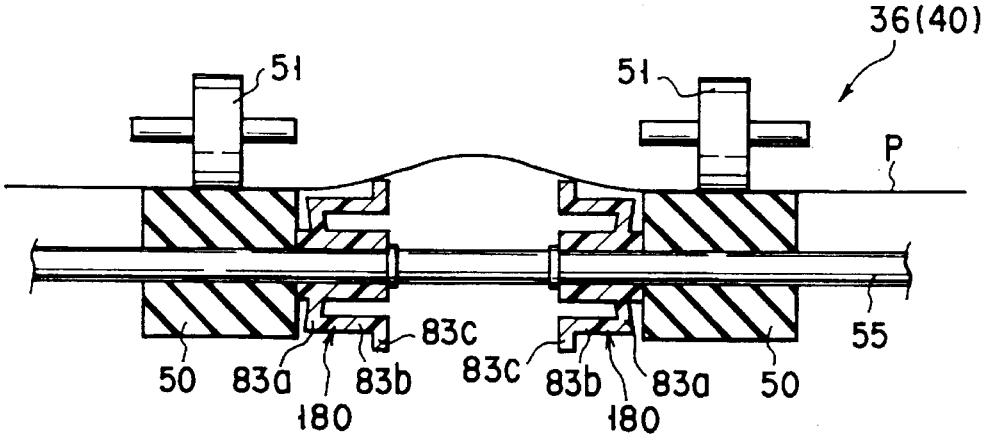
FIG. 38 is a schematic sectional view, showing a state of the corrugation roller shown in FIGS. 36 and 37, in which a corrugating function is effected.
Figure 39:
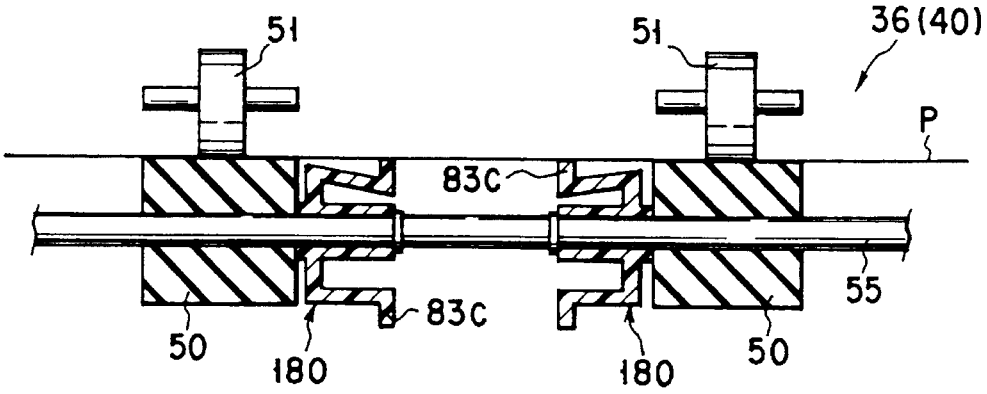
FIG. 39 is a schematic sectional view, showing a state of the corrugation roller of FIGS. 36 and 37, in which no corrugation occurs.

FIGS. 38 and 39 are cross sectional views, useful in explaining the function of the discharge unit 36 (40) having the corrugation rollers 180, 180.

As is shown in FIG. 38, when the sheet P passes between the lower and upper discharge rollers 50, 50 and 51, 51, it is corrugated toward a center portion of the shaft 55 by the corrugation rollers 180, 180. As a result, the sheet P is discharged into the first discharge tray 10 after the waves which are formed on the sheet when it is heated by the fixing unit 32 are removed.

On the other hand, when the sheet P is thicker than a predetermined thickness, the elastic arm **83*b* of each of the elastic support arm portions 83 . . . is elastically deformed by the pressing force (hardness) of the thick sheet, with the result that each projection 83*c* is displaced downward, as is shown in FIG. 39**.

Figure 40:
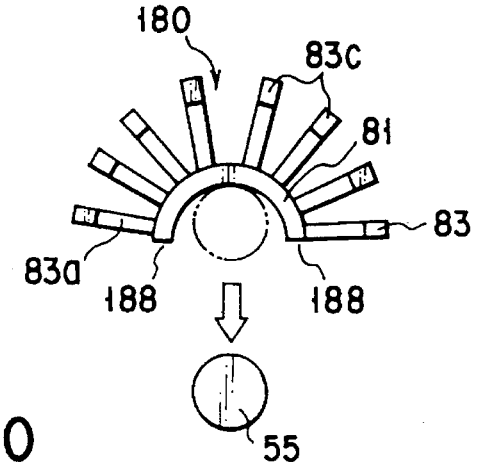
FIG. 40 is a schematic side view, useful in explaining a manner for fixing to a shaft the corrugation roller shown in FIGS. 36 and 37.

FIG. 40 is a schematic side view, more clearly showing the manner of mounting on the shaft 55 the corrugation roller shown in FIGS. 36 and 37.

FIGS. 41–45 show a corrugation roller according to an eighth embodiment. Elements similar to those employed in the above-described embodiments are denoted by corresponding reference numerals, and no detailed explanation is given thereof.

Figure 41:
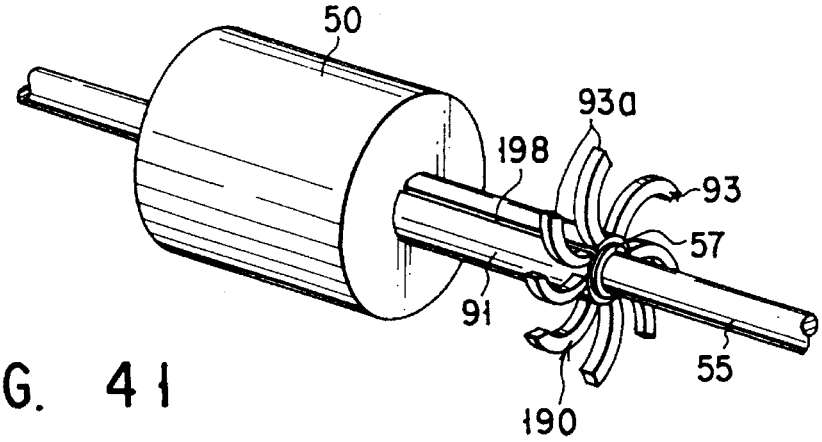
FIG. 41 is a perspective view, showing an essential part of a corrugation roller employed in the discharge unit of FIG. 3 and according to an eighth embodiment of the invention.
Figure 42A:
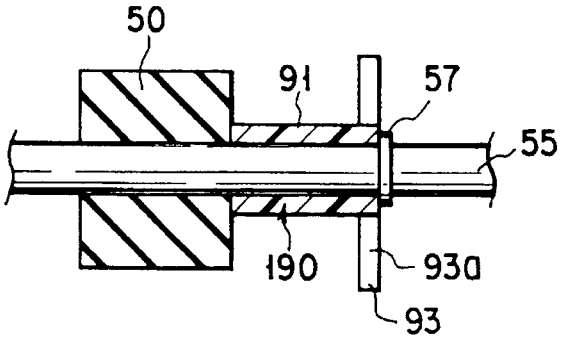
FIGS. 42A and 42B are a partial cross sectional view and a right-side view of an essential part of the corrugation roller shown in FIG. 41.
Figure 42B:
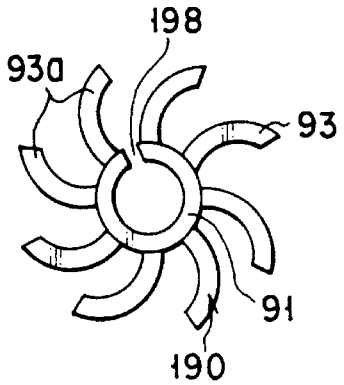

As is shown in FIGS. 41 and 42, a corrugation roller 190 has a cylindrical holding portion 91 fitted on the shaft 55, and a plurality of elastic support arm portions 93 . . . each of which radially extends from the holding portion 91.

Each of the elastic support arm portions 93 consists of a curved arm 93*a* extending radially from the holding portion 91.

The diameter of an imaginary circle formed by connecting the distal end surfaces of the arms 93*a* is set larger at least than that of the lower discharge roller 50 of the discharge unit 36 (40). The holding portion 91 has a slit 198 extending in the axial direction of the shaft 55.

Further, as in the above-described embodiments, the holding portion 91 and the elastic support arm portions 93 . . . of the corrugation roller 90 are resin-molded integral as one body. The slit 198 enables the corrugation roller 190 to be developed in a circumferential direction. Thus, the corrugation roller 190 can be brought into contact with the shaft 55 in a direction perpendicular to the axis of the shaft, and be mounted thereon.

Figure 43:
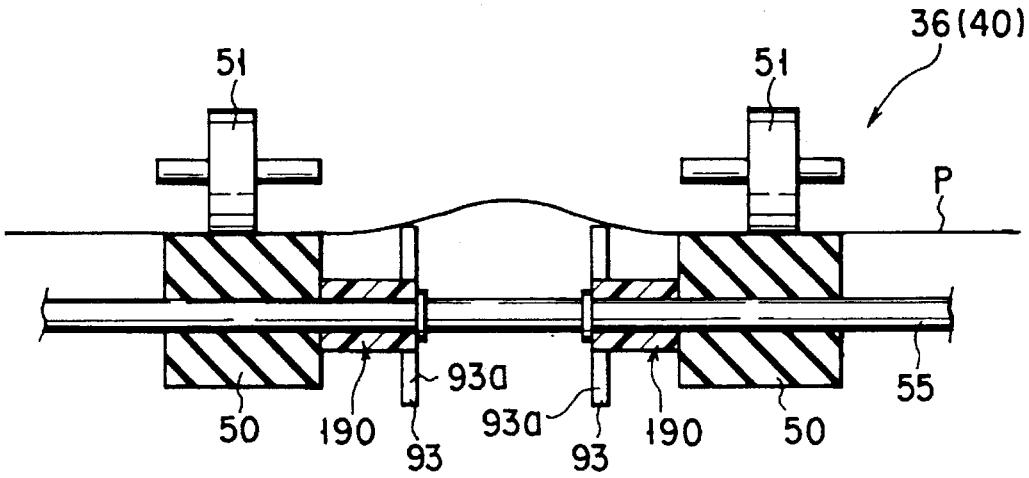
FIG. 43 is a schematic sectional view, showing a state of the corrugation roller shown in FIGS. 41 and 42, in which a corrugating function is effected.
Figure 44:
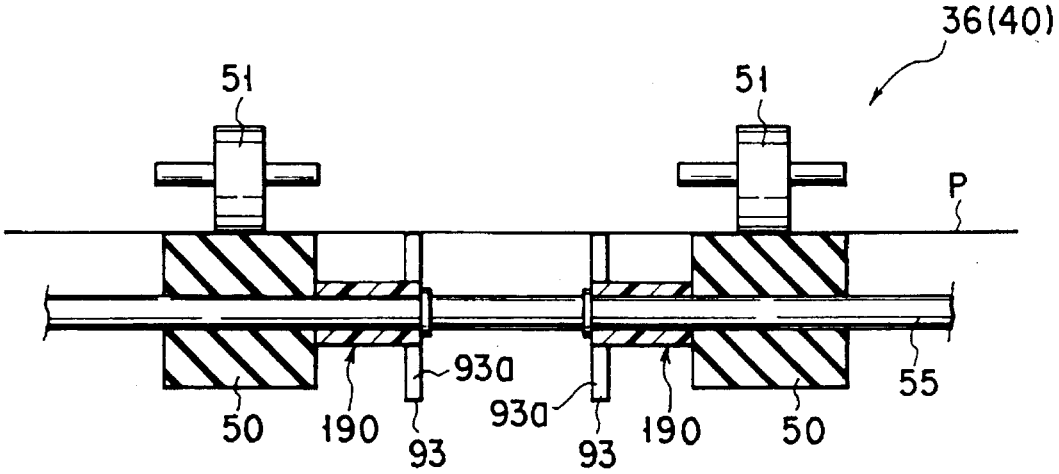
FIG. 44 is a schematic sectional view, showing a state of the corrugation roller of FIGS. 41 and 42, in which no corrugation occurs.

FIGS. 43 and 44 are cross sectional views, useful in explaining the function of the discharge unit 36 (40) having the corrugation rollers 190, 190.

As is shown in FIG. 43, when the sheet P passes between the lower and upper discharge rollers 50, 50 and 51, 51, it is corrugated toward a center portion of the shaft 55 by the corrugation rollers 190, 190. As a result, the sheet P is discharged into the first discharge tray 10 after the waves which are formed on the sheet when it is heated by the fixing unit 32 are removed.

Figure 45:
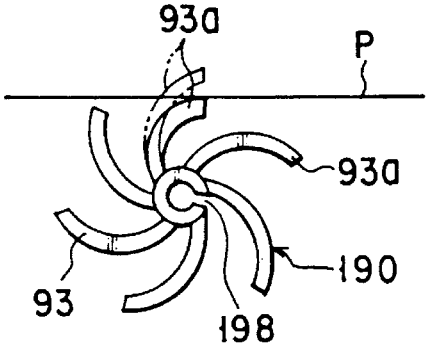
FIG. 45 is a right-side view, useful in explaining deformation of the roller in the non-corrugated state shown in FIG. 44.

On the other hand, when the sheet P is thicker than a predetermined thickness, the elastic arm 93*a* of each of the elastic support arm portions 93 . . . is elastically deformed by the pressing force (hardness) of the thick sheet, as is shown in FIGS. 44 and 45.

Figure 46:
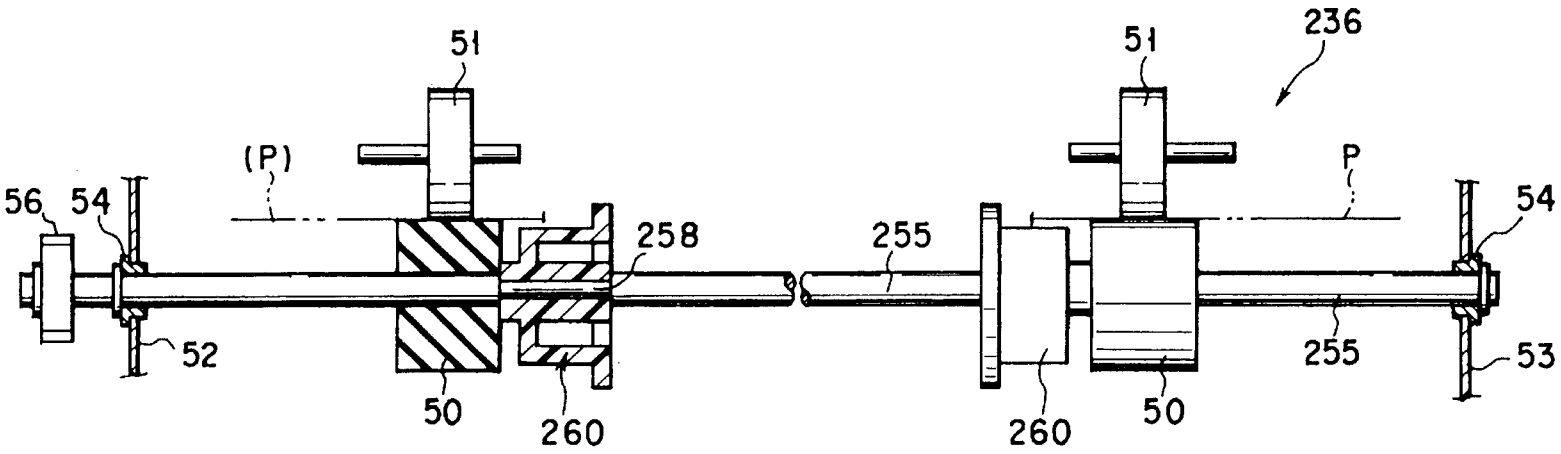
FIG. 46 is a perspective view, showing a modification of the discharge unit shown in FIG. 3.

Referring then to FIG. 46, a modification of the discharge unit shown in FIG. 3 will be explained. Since the whole structure of the modification is substantially the same as that of the unit of FIG. 3, no explanation will be given thereof.

As is shown in FIG. 46, a discharge unit 236 has lower discharge rollers 50, 50 (first discharge rollers), and upper discharge rollers 51, 51 (second discharge rollers) having thread surfaces which contact those of the rollers 50, 50.

Each of the rollers 50, 50 comprises a plurality of rubber rollers. The rollers 50, 50 are press-fitted on a shaft 255 which is rotatably supported by the frames 52 and 53 of the image forming apparatus 1 via bearings 54, 54, and can be rotated together with the shaft 255. A small-diameter portion 258 is formed in a predetermined axial position of the shaft 255 (in the vicinity of each lower discharge roller 50). A corrugation roller (hereinafter referred to) can be brought into contact with the portion 258 of the shaft 255 in a direction perpendicular to the axis of the shaft, and be mounted thereon. The small-diameter portion 258 extends in the axial direction of the shaft 255, and has a length corresponding to the axial directional length of the corrugation roller.

The shaft 255, on which the lower discharge rollers 51, 51 are mounted, has an end to which a gear 56 is attached to transmit a driving force from the driving unit (not shown) of the apparatus 2 to the shaft.

The upper discharge rollers 51, 51 are pressed against the lower discharge rollers 50, 50 with the predetermined urging force of springs (not shown). A corrugation roller 260 made of a resin of high elasticity is located in the vicinity of each lower discharge roller 50.

In FIG. 46, the sheet P with a toner image, having passed the fixing unit 32, passes between the lower and upper discharge rollers 50 and 51 from the back side to the front side, the front side being that side of FIG. 46 visible therein.

Referring then to FIGS. 47–51, a corrugation roller suitable to the discharge unit 236 of FIG. 46 and according to a ninth embodiment of the invention will be explained.

Figure 48:
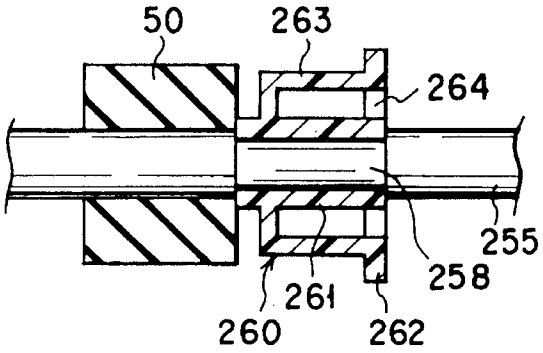
FIG. 48 is a cross sectional view, showing an essential part of the corrugation roller shown in FIG. 47.
Figure 47:
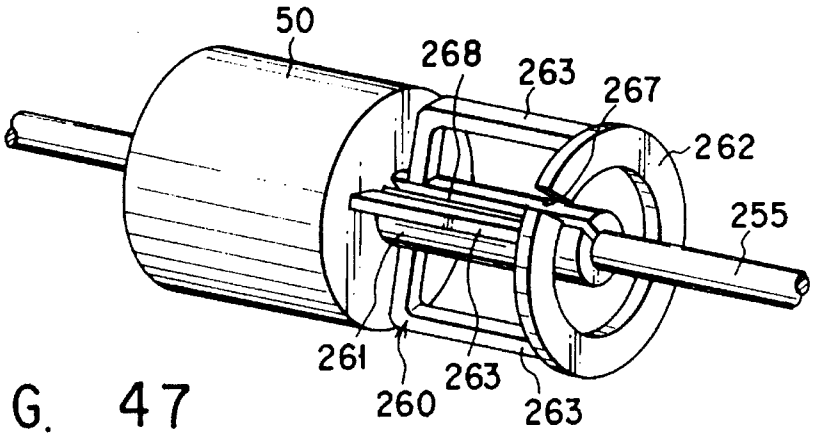
FIG. 47 is a perspective view, showing an essential part of a corrugation roller according to a ninth embodiment of the invention, which is suitable to the discharge unit of FIG. 46.

As is shown in FIGS. 47 and 48, the corrugation roller 260 has a cylindrical holding portion 261 covering the small-diameter portion 258 of the shaft 255 from the outside, an annular roller main body 262 capable of being brought into contact with the sheet P, and a plurality of elastic support arm portions 263 . . . , etc. The holding portion 261 and the roller main body 262 have respective slits 267 and 268 formed in the axial direction of the shaft 255. The holding portion 261, the roller main body 262 and the elastic support arm portions 263 are resin-molded integral as one body. The slits 267 and 268 enable the corrugation roller 260 to be developed in a circumferential direction. Thus, the corrugation roller 160 can be brought into contact with the shaft 255 in a direction perpendicular to the axis of the shaft, and be mounted thereon.

Since the shaft 255 has the small-diameter portion 258, the corrugation roller 260 can be reliably fixed by only mounting the same on the small-diameter portion 258 of the shaft 255 from the outside, thereby preventing the roller from moving in the axial direction of the shaft. Further, by virtue of the small-diameter portion 258, a particular fixing member such as a stop ring is not necessary. In addition, the small-diameter portion 258 can reduce the amount of the circumferential development of the corrugation roller 260 which is performed to mount the roller on the shaft. Therefore, the roller main body 262, the holding portion 261 and the support arm portions 263 . . . are prevented from being broken during when the corrugation roller 260 is developed, and the efficiency of assembling is increased.

Figure 49:
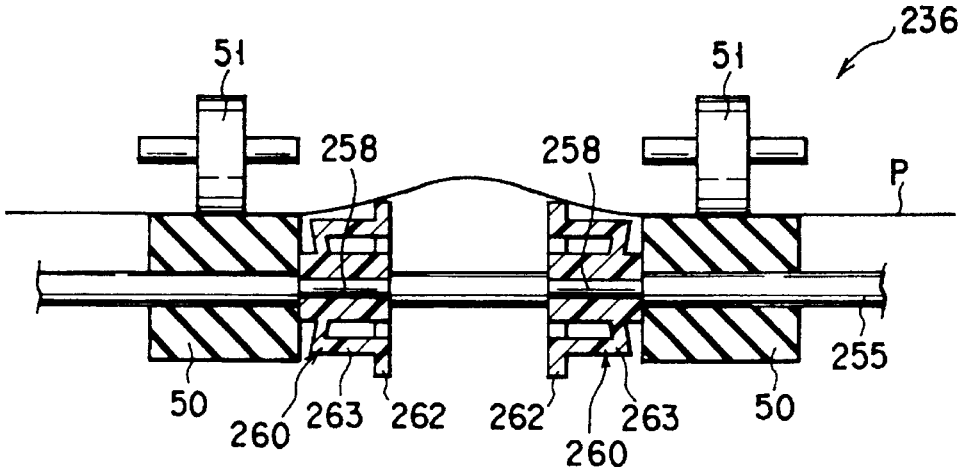
FIG. 49 is a schematic sectional view, showing a state of the corrugation roller of FIGS. 47 and 48, in which a corrugating function is effected.
Figure 50:
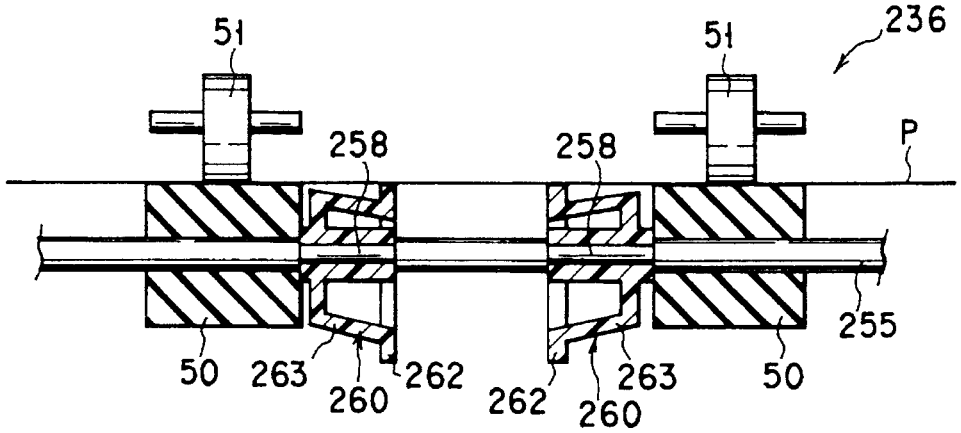
FIG. 50 is a schematic sectional view, showing a state of the corrugation roller of FIGS. 47 and 48, in which no corrugation occurs.

FIGS. 49 and 50 are cross sectional views, useful in explaining the function of the discharge unit 236 (40) having the corrugation rollers 260, 260.

As is shown in FIG. 49, when the sheet P passes between the lower and upper discharge rollers 50, 50 and 51, 51, it is corrugated toward a center portion of the shaft 55 by the corrugation rollers 260, 260. As a result, the sheet P is discharged into the first discharge tray 10 after the waves which are formed on the sheet when it is heated by the fixing unit 32 are removed.

On the other hand, when the sheet P is thicker than a predetermined thickness, the elastic support arm portions 263 . . . are elastically deformed by the pressing force (hardness) of the thick sheet, with the result that the roller main body 262 is deformed downward, as is shown in FIG. 50.

Figure 51:
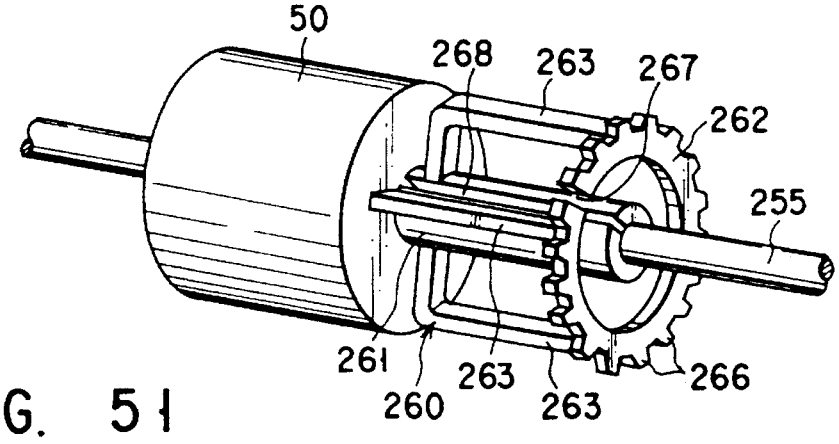
FIG. 51 is a perspective view, showing a modification of the corrugation roller shown in FIGS. 47 and 48.

FIG. 51 shows a modification of the corrugation roller shown in FIGS. 47 and 48.

As is shown in FIG. 51, the roller main body 262 of the corrugation roller 260 has a plurality of projections 266 formed at the periphery thereof at regular intervals. The projections 266 enable reliable transfer (discharge) of the sheet P between the rollers 50 and 51.

Referring then to FIGS. 52–57, a corrugation roller according to a tenth embodiment, which is suitable to the discharge unit of FIG. 46, will be explained. In these figures, elements similar to those employed in the above-described embodiments are denoted by corresponding reference numerals, and no detailed explanation will be given thereof.

Figure 52:
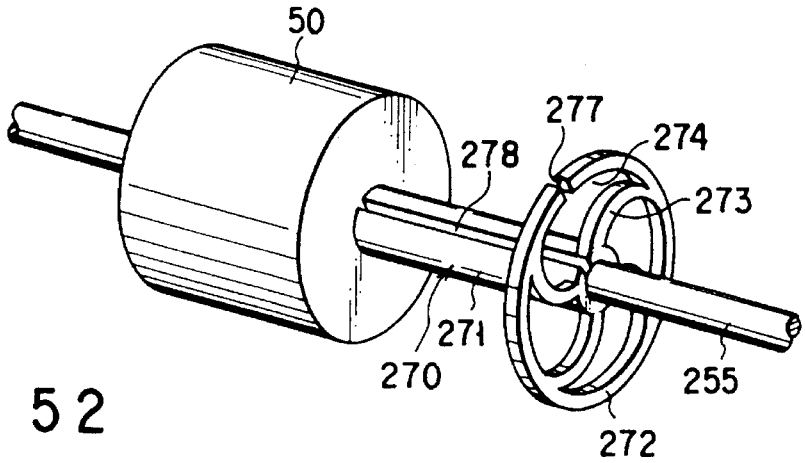
FIG. 52 is a perspective view, showing an essential part of a corrugation roller according to a tenth embodiment of the invention, which is suitable to the discharge unit of FIG. 46.
Figure 53A:
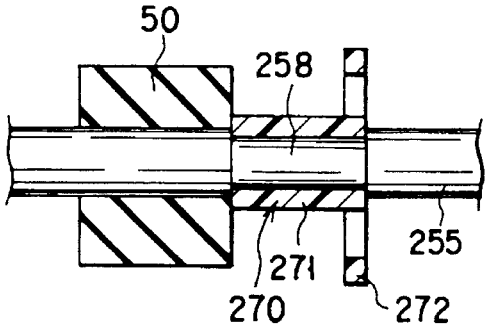
FIGS. 53A and 53B are a partial cross sectional view and a right-side view of an essential part of the corrugation roller shown in FIG. 52.
Figure 53B:
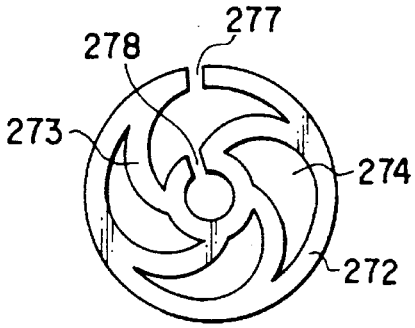

As is shown in FIGS. 52 and 53, a corrugation roller 270 has a cylindrical holding portion 271 mounted on the small-diameter portion 258 of the shaft 255, an annular roller main body 272 capable of being brought into contact with the sheet P, and a plurality of elastic support arm portions 273 each of which extends radially and circumferentially, connecting the holding portion 271 to the roller main body 272. The holding portion 271 and the main body 272 have respective slits 277 and 278 formed in the axial direction of the shaft 255.

As in the above-described embodiments, the holding portion 271, the roller main body 272 and the support arm portions 273 . . . are resin-molded integral as one body. The slits 277 and 278 enable the corrugation roller 270 to be developed in a circumferential direction. Thus, the corrugation roller 270 can be brought into contact with the shaft 255 in a direction perpendicular to the axis of the shaft, and be mounted thereon.

In this case, too, the corrugation roller 270 can be reliably fixed by only mounting the same on the small-diameter portion 258 of the shaft 255 from the outside, thereby preventing the roller from moving in the axial direction of the shaft. Further, by virtue of the small-diameter portion 258, a particular fixing member such as a stop ring is not necessary. In addition, the small-diameter portion 258 can reduce the amount of the circumferential development of the corrugation roller 270 which is performed to mount the roller on the shaft. Therefore, the roller main body 272, the holding portion 271 and the support arm portions 273 . . . are prevented from being broken during when the corrugation roller 270 is developed, and the efficiency of assembling is increased.

Figure 54:
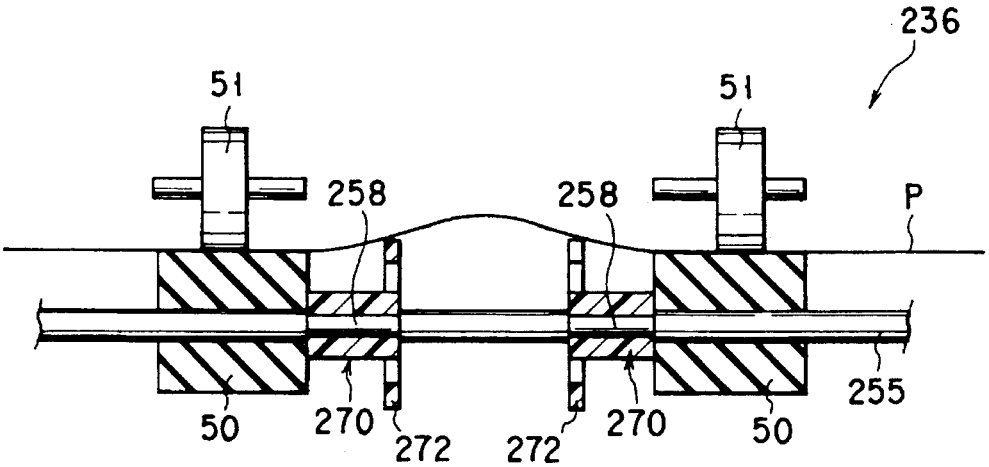
FIG. 54 is a schematic sectional view, showing a state of the corrugation roller of FIGS. 52 and 53, in which a corrugating function is effected.
Figure 55:
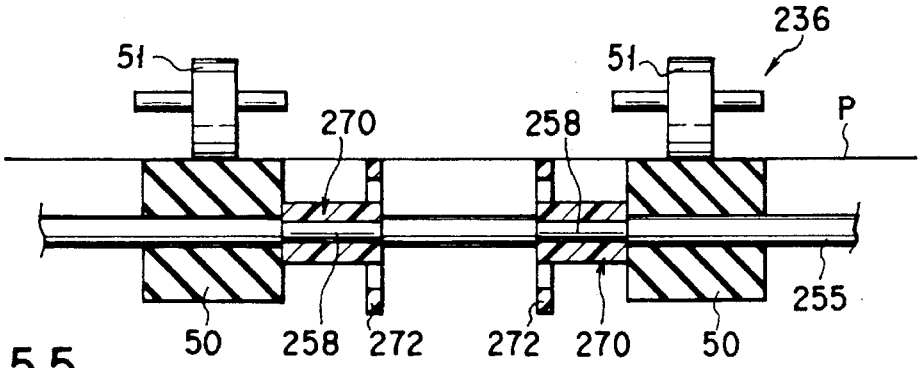
FIG. 55 is a schematic sectional view, showing a state of the corrugation roller of FIGS. 52 and 53, in which no corrugation occurs.

FIGS. 54 and 55 are cross sectional views, useful in explaining the function of the discharge unit 236 (40) having the corrugation rollers 270, 270.

As is shown in FIG. 54, when the sheet P passes between the lower and upper discharge rollers 50, 50 and 51, 51, it is corrugated toward a center portion of the shaft 55 by the corrugation rollers 270,270. As a result, the sheet P is discharged into the first discharge tray 10 after the waves which are formed on the sheet when it is heated by the fixing unit 32 are removed.

Figure 56:
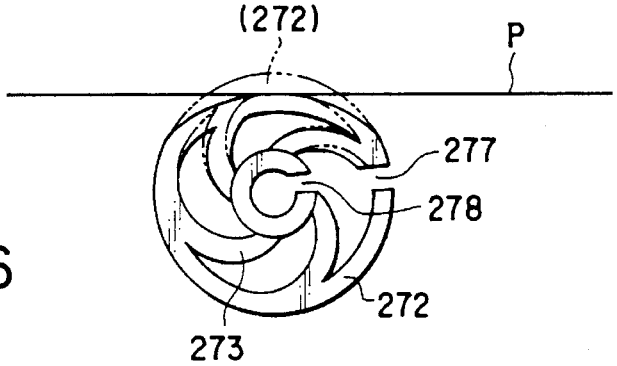
FIG. 56 is a right-side view, useful in explaining the deformation of the roller in the non-corrugated state shown in FIG. 55.

On the other hand, when the sheet P is thicker than a predetermined thickness, the elastic support arm portions 273 . . . are elastically deformed by the pressing force (hardness) of the thick sheet, with the result that the roller main body 272 is deformed downward, as is shown in FIGS. 55 and 56.

Figure 57:
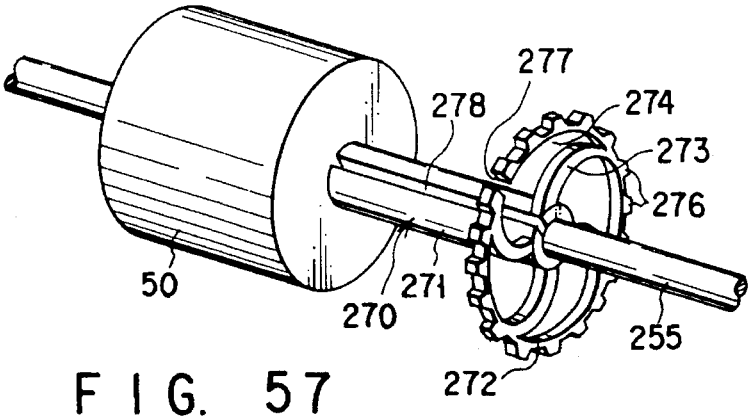
FIG. 57 is a perspective view, showing a modification of the corrugation roller shown in FIGS. 52 and 53.

FIG. 57 shows a modification of the corrugation roller shown in FIGS. 52 and 53.

As is shown in FIG. 57, the roller main body 272 of the corrugation roller 270 has a plurality of projections 276 formed at the periphery thereof at regular intervals. The projections 276 enable reliable transfer (discharge) of the sheet P between the rollers 50 and 51.

Referring then to FIGS. 58–62, a corrugation roller according to an eleventh embodiment, which is suitable to the discharge unit of FIG. 46, will be explained. In these figures, elements similar to those employed in the above-described embodiments are denoted by corresponding reference numerals, and no detailed explanation will be given thereof.

Figure 58:
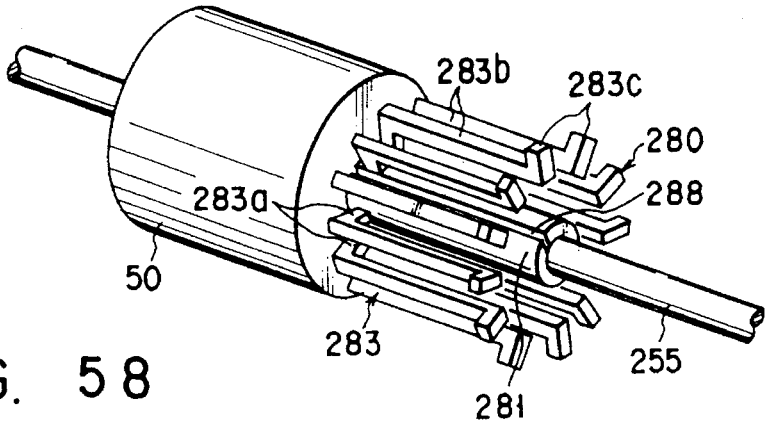
FIG. 58 is a perspective view, showing an essential part of a corrugation roller according to an eleventh embodiment of the invention, which is suitable to the discharge unit of FIG. 46.
Figure 59A:
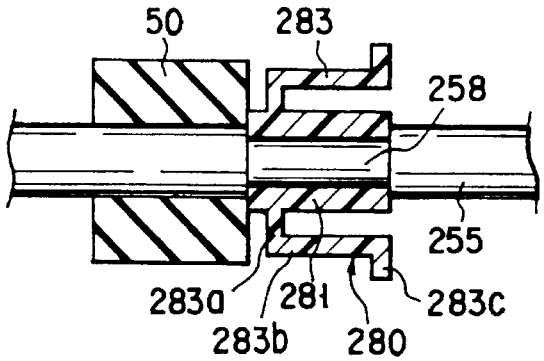
FIGS. 59A and 59B are a partial cross sectional view and a right-side view of an essential part of the corrugation roller shown in FIG. 58.
Figure 59B:
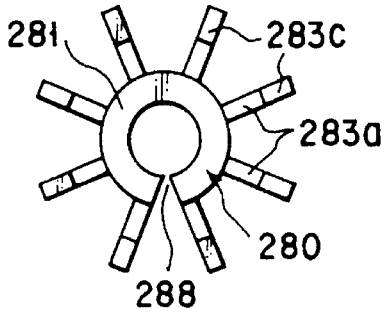

As is shown in FIGS. 58 and 59, a corrugation roller 280 has a cylindrical holding portion 281 mounted on the small-diameter portion 258 of the shaft 255, and a plurality of elastic support arm portions 283 each of which radially extends from the holding portion 281.

Each of the elastic support arm portions 283 has a leg portion 283*a* radially extending from the holding portion 281, an elastic arm 283*b* extending parallel to the holding portion 281, and a projection 283*c* projecting from the elastic arm 283*b* in a direction remote from the holding portion 281 (shaft 255). If each elastic support arm portion 283 has an optimal configuration, the corrugation roller 280 can be made such that only the distance between the elastic arm 283*b* and the holding portion 281 (shaft 255) is varied in accordance with the amount of force applied thereto. The holding portion 281 has a slit 288 extending in the axial direction of the shaft 255. Further, as in the above-described embodiments, the holding portion 281 and the elastic support arm portions 283 . . . of the corrugation roller 280 are resin-molded integral as one body. The slit 288 enables the corrugation roller 280 to be developed in a circumferential direction. Thus, the corrugation roller 280 can be brought into contact with the shaft 255 in a direction perpendicular to the axis of the shaft, and be mounted thereon.

In this case, too, the corrugation roller 280 can be reliably fixed by only mounting the same on the small-diameter portion 258 of the shaft 255 from the outside, thereby preventing the roller from moving in the axial direction of the shaft. Further, by virtue of the small-diameter portion 258, a particular fixing member such as a stop ring is not necessary. In addition, the small-diameter portion 258 can reduce the amount of the circumferential development of the corrugation roller 280 which is performed to mount the roller on the shaft. Therefore, the holding portion 281 and the support arm portions 273 . . . are prevented from being broken during when the corrugation roller 280 is developed, and the efficiency of assembling is increased.

Figure 60:
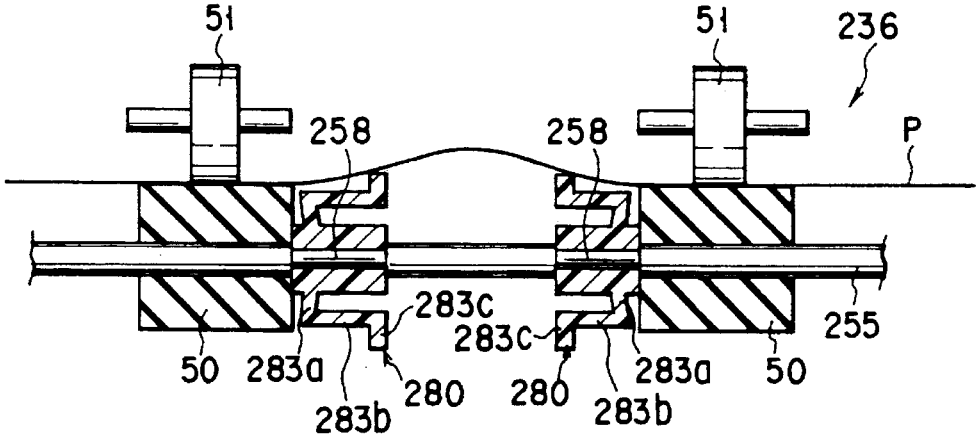
FIG. 60 is a schematic sectional view, showing a state of the corrugation roller shown in FIGS. 58 and 59, in which a corrugating function is effected.
Figure 61:
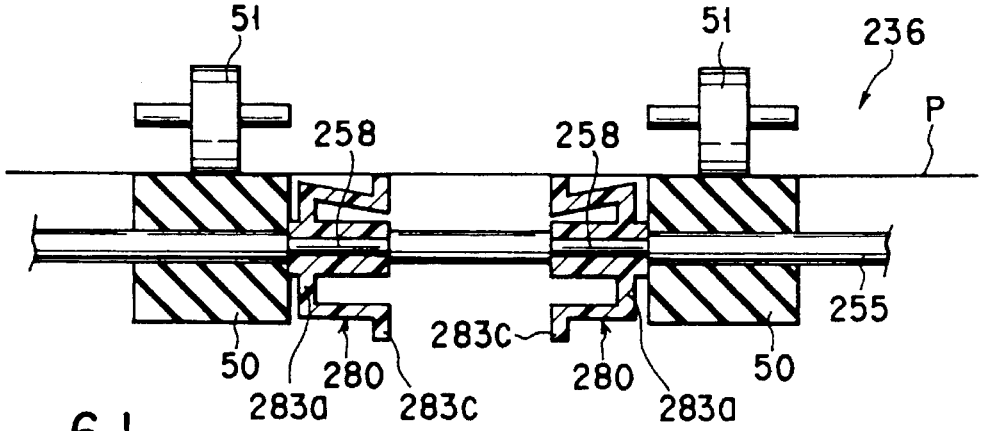
FIG. 61 is a schematic sectional view, showing a state of the corrugation roller of FIGS. 58 and 59, in which no corrugation occurs.

FIGS. 60 and 61 are cross sectional views, useful in explaining the function of the discharge unit 236 (40) having the corrugation rollers 280, 280.

As is shown in FIG. 60, when the sheet P passes between the lower and upper discharge rollers 50, 50 and 51, 51, it is corrugated toward a center portion of the shaft 55 by the corrugation rollers 280, 280. As a result, the sheet P is discharged into the first discharge tray 10 after the waves which are formed on the sheet when it is heated by the fixing unit 32 are removed.

On the other hand, when the sheet P is thicker than a predetermined thickness, the elastic arms 283*b* of the elastic support arm portions 283 . . . are elastically deformed by the pressing force (hardness) of the thick sheet, with the result that the projections 283*c* are displaced downward, as is shown in FIG. 61.

Figure 62:
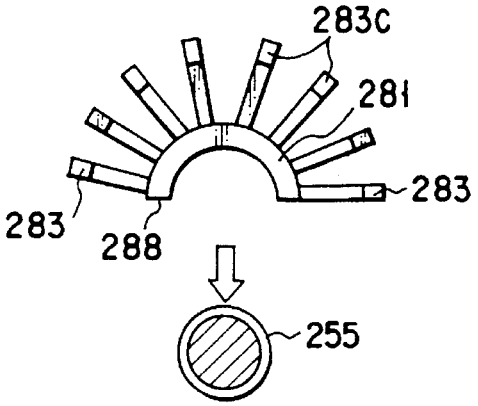
FIG. 62 is a schematic side view, useful in explaining a manner for fixing to a shaft the corrugation roller shown in FIGS. 58 and 59.

FIG. 62 is a schematic view, useful in more clearly explaining how the corrugation roller of FIGS. 58 and 59 is mounted on the shaft 255.

FIGS. 63–67 show a corrugation roller according to a twelfth embodiment of the invention, which is suitable to the discharge unit of FIG. 46. In these figures, elements similar to those employed in the above-described embodiments are denoted by corresponding reference numerals, and no detailed explanation will be given thereof.

Figure 63:
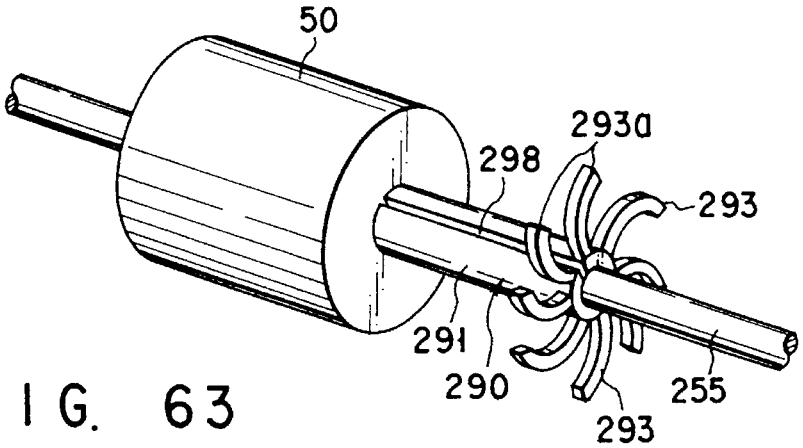
FIG. 63 is a perspective view, showing an essential part of a corrugation roller according to a twelfth embodiment of the invention, which is suitable to the discharge unit of FIG. 46.
Figure 64A:
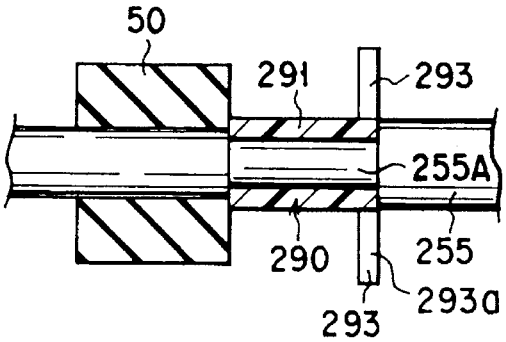
FIGS. 64A and 64B are a partial cross sectional view and a right-side view of an essential part of the corrugation roller shown in FIG. 62.
Figure 64B:
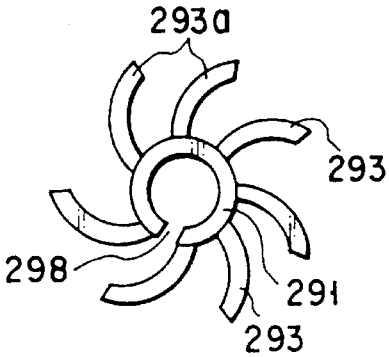

As is shown in FIGS. 63 and 64, a corrugation roller 290 has a cylindrical holding portion 291 mounted on the small-diameter portion 258 of the shaft 255, and a plurality of elastic support arm portions 293 each of which radially extends from the holding portion 291.

Each of the elastic support arm portions 293 has a curved elastic arm 293*a* radially extending from the holding portion 291. The diameter of an imaginary circle formed by connecting the distal end surfaces of the arms 293*a* is set larger at least than the diameter of the lower discharge roller 50 of the discharge unit 236. The holding portion 291 has a slit 298 extending in the axial direction of the shaft 255.

Further, as in the above-described embodiments, the holding portion 291 and the elastic support arm portions 293 . . . of the corrugation roller 290 are resin-molded integral as one body. The slit 298 enables the corrugation roller 290 to be developed in a circumferential direction. Thus, the corrugation roller 290 can be brought into contact with the shaft 255 in a direction perpendicular to the axis of the shaft, and be mounted thereon.

As in the above-described embodiments, the corrugation roller 290 can be reliably fixed by only mounting the same on the small-diameter portion 258 of the shaft 255 from the outside, thereby preventing the roller from moving in the axial direction of the shaft. Further, by virtue of the small-diameter portion 258, a particular fixing member such as a stop ring is not necessary. In addition, the small-diameter portion 258 can reduce the amount of the circumferential development of the corrugation roller 290 which is performed to mount the roller on the shaft. Therefore, the holding portion 291 and the support arm portions 293 . . . are prevented from being broken during when the corrugation roller 290 is developed, and the efficiency of assembling is increased.

FIGS. 65 and 66 are cross sectional views, useful in explaining the function of the discharge unit 236 having the corrugation rollers 290, 290.

As is shown in FIG. 65, when the sheet P passes between the lower and upper discharge rollers 50, 50 and 51, 51, it is corrugated toward a center portion of the shaft 55 by the corrugation rollers 290, 290. As a result, the sheet P is discharged into the first discharge tray 10 after the waves which are formed on the sheet when it is heated by the fixing unit 32 are removed.

On the other hand, when the sheet P is thicker than a predetermined thickness, the elastic arms 293*a* of the elastic support arm portions 293 are elastically deformed and warped downward by the pressing force (hardness) of the thick sheet, as is shown in FIGS. 66 and 67.

As explained above, the first and second discharge units 36 and 40 can employ various types of resin-molded corrugation rollers, which impart a corrugation effect to a thin paper sheet by the use of their elastically supported main bodies, and imparts no corrugation effect to a thick paper sheet as a result of elastic deformation of the elastically supported main bodies. Thus, the thick paper sheet can be prevented from being wrinkled.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A paper sheet transfer apparatus comprising:

a pair of transfer rollers each having a predetermined diameter opposed to each other for transferring a sheet of paper along a paper sheet transfer plane extending between the pair of transfer rollers by holding the sheet of paper therebetween;

a rotary shaft located coaxial with one of the transfer rollers; and a corrugation roller rotatably mounted on the rotary shaft for corrugating the sheet of paper transferred by the transfer rollers, in a direction perpendicular to the direction of the transfer of the sheet of paper, the corrugation roller having:

a roller main body with a diameter larger than the diameter of each of said transfer rollers, for corrugating the sheet of paper, the roller main body projecting from the paper sheet transfer plane toward the other one of the transfer rollers;

a holding portion mounted on the rotary shaft for holding the roller main body on that portion of the rotary shaft which is not opposed to the other one of the transfer rollers; and a support portion extending between the holding portion and the roller main body, the support portion being able to be warped in accordance with the thickness of the sheet of paper transferred by the transfer rollers, for deformably supporting the roller main body, and restraining the amount of projection of the roller main body from the paper sheet transfer plane of the one of the transfer rollers and the amount of the corrugation, the roller main body, the holding portion and the support portion being resin-molded integral as one body.

2. The paper sheet transfer apparatus according to claim 1, wherein the roller main body of the corrugation roller is formed annular.

3. The paper sheet transfer apparatus according to claim 1, wherein the roller main body of the corrugation roller includes an arm portion radially developed.

4. The paper sheet transfer apparatus according to claim 1, wherein the roller main body of the corrugation roller includes an arm portion radially and circumferentially developed.

5. The paper sheet transfer apparatus according to claim 1, wherein the roller main body of the corrugation roller consists of a partially cut annular member.

6. A paper sheet transfer apparatus comprising:

transfer roller means including an axial portion and a tread surface having a first radius;

auxiliary roller means including an axial portion and an opposed tread surface having a second radius and opposed to the tread surface having the first diameter, the opposed tread surface being rotated in accordance with the rotation of the transfer roller means; and deformable roller means having a body portion formed integral with one of the axial portions of the transfer roller means and the auxiliary roller means, the body portion giving a sheet material a force exerting in a direction perpendicular to a direction in which the sheet material is transferred between the tread surfaces of said transfer roller means and the auxiliary roller means, the deformable roller means including at least one corrugating portion for giving said force exerting in the direction perpendicular to the direction of the transfer, the at least one corrugating portion including at least one corrugating element which extends around said one of the axial portions, the at least one corrugating element having a outermost surface, the distance between the outermost surface and an axis of said one of the axial portions being larger than the first radius and the second radius, and the outermost surface of the deformable roller means being able to be deformed to have the same level as the tread surface of said one of the axial portions of the transfer roller means and the auxiliary roller means, when the hardness of the sheet material which corresponds to a thickness thereof exceeds a predetermined value.

7. The paper sheet transfer apparatus according to claim 6, wherein the corrugating portion of the deformable roller means includes connecting means which connects the corrugating element of the deformable roller means to the body portion of the same.

8. The paper sheet transfer apparatus according to claim 7, wherein the body portion, the corrugating portion and the corrugating element are resin-molded integral as one body.

9. The paper sheet transfer apparatus according to claim 6, wherein the corrugating element is formed annular.

10. The paper sheet transfer apparatus according to claim 6, wherein the corrugating element includes an arm portion radially developed.

11. The paper sheet transfer apparatus according to claim 6, wherein the corrugating element includes an arm portion radially and circumferentially developed.

12. The paper sheet transfer apparatus according to claim 6, wherein the corrugating element consists of a partially cut annular member.

13. The paper sheet transfer apparatus according to claim 6, further comprising a shaft member wherein the roller main body of the corrugation roller is formed annular.

14. The paper sheet transfer apparatus according to claim 13, wherein the shaft member includes a small-diameter portion on which the body portion is mounted.

15. A corrugation roller comprising:

a body member mounted on a shaft;

corrugating means having at least one portion, the distance between an outermost surface of the at least one portion and an axis of the shaft being larger than a radius of any one of roller members mounted on the shaft; and connecting means connecting the corrugating means and the body member, and including elastically deformable members which extend parallel to an axis of the shaft, and support members radially extending between the elastically deformable members and the body member.

16. The corrugation roller according to claim 15, wherein the corrugation means extends from the elastically deformable members of the connecting means.

* * * * *